US008263304B2

(12) United States Patent
Honda et al.

(10) Patent No.: US 8,263,304 B2
(45) Date of Patent: Sep. 11, 2012

(54) TONER, METHOD FOR PRODUCING TONER, AND DEVELOPER

(75) Inventors: Takahiro Honda, Fujinomiya (JP); Yohichiroh Watanabe, Fuji (JP); Kazumi Suzuki, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 507 days.

(21) Appl. No.: 12/550,925

(22) Filed: Aug. 31, 2009

(65) Prior Publication Data

US 2010/0055590 A1 Mar. 4, 2010

(30) Foreign Application Priority Data

Sep. 1, 2008 (JP) ..... 2008-223729

(51) Int. Cl.
*G03G 9/08* (2006.01)

(52) U.S. Cl. ..... 430/137.1; 430/108.8; 430/110.1

(58) Field of Classification Search ..... 430/137.1, 430/108.8, 110.1
See application file for complete search history.

(56) References Cited

U.S. PATENT DOCUMENTS

| | | | | |
|---|---|---|---|---|
| 2008/0003516 | A1* | 1/2008 | Akioka et al. | 430/113 |
| 2008/0063971 | A1 | 3/2008 | Watanabe et al. | |
| 2008/0248416 | A1 | 10/2008 | Norikane et al. | |
| 2008/0286679 | A1 | 11/2008 | Norikane et al. | |
| 2008/0286680 | A1 | 11/2008 | Norikane et al. | |
| 2008/0292985 | A1 | 11/2008 | Suzuki et al. | |
| 2009/0042118 | A1 | 2/2009 | Suzuki et al. | |
| 2009/0117486 | A1 | 5/2009 | Watanabe et al. | |
| 2009/0239170 | A1 | 9/2009 | Honda et al. | |

FOREIGN PATENT DOCUMENTS

| | | |
|---|---|---|
| JP | 7-152202 | 6/1995 |
| JP | 2001-249485 | 9/2001 |
| JP | 2006-28432 | 2/2006 |
| JP | 2006-28433 | 2/2006 |
| JP | 3786034 | 3/2006 |
| JP | 3786035 | 3/2006 |
| JP | 3849832 | 9/2006 |
| JP | 3952817 | 5/2007 |
| JP | 2008-292976 | 12/2008 |
| WO | WO 2008/114655 A1 | 9/2008 |

OTHER PUBLICATIONS

U.S. Appl. No. 12/488,843, filed Jun. 22, 2009, Honda, et al.
U.S. Appl. No. 12/503,444, filed Jul. 15, 2009, Watanabe, et al.

* cited by examiner

*Primary Examiner* — Hoa V Le
(74) *Attorney, Agent, or Firm* — Oblon, Spivak, McClelland, Maier & Neustadt, L.L.P.

(57) ABSTRACT

A method for producing a toner including periodically forming and discharging liquid droplets of a toner composition liquid containing at least a resin, a releasing agent and a colorant from a plurality of nozzles formed in a thin film which is provided in a reservoir for the toner composition liquid, by vibrating the thin film using a mechanically vibrating unit, and forming toner particles by solidifying the liquid droplets, wherein the forming toner particles comprises primarily drying the liquid droplets under a stream of dry gas containing an organic solvent whose partial pressure is equal to or higher than 1/10 of a saturated vapor pressure thereof but is equal to or lower than the saturated vapor pressure, the saturated vapor pressure being that at a drying temperature; and secondarily drying the primarily dried liquid droplets for solidification while the organic solvent is being evaporated.

18 Claims, 12 Drawing Sheets

TONER, METHOD FOR PRODUCING TONER, AND DEVELOPER

BACKGROUND OF THE INVENTION

1. Field of the Invention

The present invention relates to a method for producing a toner used in a developer for developing a latent electrostatic image in, for example, electrophotography, electrostatic recording and electrostatic printing; to a toner produced with the production method; and to a developer containing the toner.

2. Description of the Related Art

Developers used conventionally in, for example, electrophotography, electrostatic recording and electrostatic printing adhere, in a developing step, to an image bearing member (e.g., a latent electrostatic image bearing member) on which a latent electrostatic image has been formed; then, in a transfer step, are transferred from the image bearing member onto a recording medium (e.g., recording paper sheet); and then, in a fixing step, are fixed on the surface of the recording medium. As have been known, such developers that develop a latent electrostatic image formed on the image bearing member are roughly divided into two-component developers formed of a carrier and a toner and one-component developers requiring no carrier (magnetic or non-magnetic toners).

As the above-described toner, a pulverized toner is widely used, which is produced by melt-kneading a toner binder (e.g. a styrene resin and a polyester resin) together with a colorant, followed by finely pulverizing.

Also, the recent interest has focused on polymerization toners produced with the suspension polymerization method or the emulsion polymerization aggregation method. In addition, Japanese Patent Application Laid-Open (JP-A) No. 07-152202 discloses a polymer dissolution suspension method. In this method, toner materials are dispersed and/or dissolved in a volatile solvent such as an organic solvent having a low boiling point; and the resultant liquid is emulsified in an aqueous medium in the presence of a dispersant to form liquid droplets; and the volatile solvent is removed from the liquid droplets while shrinking the volume thereof. Unlike the suspension polymerization method and the emulsion polymerization aggregation method, the polymer dissolution suspension method is advantageous in that a wider variety of resins can be used; in particular, a polyester resin can be used which is used for forming a full-color image having transparency and smoothness in image portions after fixing.

The polymerization toners must be prepared in an aqueous medium in the presence of a dispersant and thus, the dispersant remains on the surface of the formed toner particles and degrades chargeability and environmental stability thereof. In order to avoid such an unfavorable phenomenon, the remaining dispersant must be removed using a very large amount of wash water and thus, the production method for the polymerization toner is not necessarily satisfactory.

As a method for producing a toner replacing the above polymerization toner, for example, JP-A No. 2003-262976 discloses a method in which a toner composition liquid is formed into microdroplets by piezoelectric pulsation, and the thus-formed microdroplets are solidified through drying to produce toner particles. Also, JP-A No. 2003-280236 discloses a method in which a toner composition liquid is formed into microdroplets by the action of thermal expansion, and the thus-formed microdroplets are solidified through drying to produce toner particles. In addition, JP-A No. 2003-262977 discloses a method in which a toner composition liquid is formed into microdroplets using an acoustic lens, and the thus-formed microdroplets are solidified through drying to produce toner particles.

However, these methods pose a problem in that the number of liquid droplets that can be ejected from one nozzle per unit of time is limited to make their productivity low. Furthermore, it is difficult to prevent the particle size distribution of the formed toner from broadening due to aggregation of liquid droplets. Thus, these methods are far from satisfaction in terms of monodispersibility of the formed toner as well as productivity.

Also, JP-A Nos. 2006-28432 and 2006-28433 disclose a method in which toner materials containing a thermosetting resin or UV curable resin is finely dispersed in a dispersion medium; the resultant dispersion is intermittently discharged from nozzles in the form of liquid droplet; the formed liquid droplets are aggregated and then a thermosetting resin or UV curable resin is cured for stabilizing particle formation. This method, however, exhibits low productivity and forms toner particles having insufficient monodispersibity, similar to the above-described methods disclosed in JP-A Nos. 07-152202, 2003-262976, 2003-280236 and 2003-262977. The toner produced with this method does not have a sufficient fixing property, although the resin is cured after toner particle formation.

The above granulation method disclosed in JP-A Nos. 2006-28432 or 2006-28433 is characterized in that an excitation part (vibration part) is in direct contact with a fluid. In this configuration, when the number of the excitation part is identical to that of micropores (orifices) (i.e., excitation parts correspond one-to-one to micropores (orifices)), the formed toner have a sharp particle size distribution. Meanwhile, when a plurality of micropores and one excitation part are used, the size of liquid droplets discharged from micropores varies with the distance between the excitation part and each micropore and thus, toner particles formed from liquid droplets discharged from different micropores (orifices) have different particle diameters.

For producing a high-quality image, toners have been improved by, for example, making the toner particle diameter smaller lo or the particle size distribution narrower. The toner particles produced with the common kneading pulverizing toner production method have an amorphous shape and thus, are further pulverized through stirring together with carrier particles in the development area of an image forming apparatus. In addition, when used as a one-component developer, the above toner particles are further pulverized through contact with, for example, a developing roller, a toner-feeding roller, a layer thickness-controlling blade and a frictionally charging blade. As a result, extremely fine particles are formed and a flowability improver is embedded in the toner surface, resulting in degrading image quality. Also, the toner particles having such a shape exhibit poor powder flowability and thus, require a large amount of a flowability improver. Furthermore, the filling rate of a toner bottle with such toner particles becomes low, preventing downsizing of apparatuses.

Also, transfer processes for forming a full-color image become more complicated, which transfer multi-color toner images from photoconductors onto a recording medium or paper. When the pulverized toner having an amorphous shape is used in the transfer processes, print through is often observed on the formed image due to its poor transferability and a large amount of toner must be consumed for compensating the print through, which is problematic.

Under such circumstances, there are increasing needs to more reliably transfer toner particles, to reduce the amount of toner consumed, to form high-quality image involving no image through, and to reduce running cost. When transfer efficiency is very high, there is not required to be provided a cleaning unit for removing toner particles remaining the photoconductor or transfer medium. Other advantageous effects are as follows: apparatuses can be downsized, cost reduction can be attained, and no toner to be disposed of is generated. In order to overcome the above-described problems caused by toner particles having an amorphous shape, attempts have been made to develop various production methods for spherical toner particles.

For example, JP-A Nos. 2000-75549 and 2001-249485 disclose toner particles containing, in combination, a styrene resin and a polyester resin excellent in low-temperature fixing property. However, these toner particles, which are produced with the kneading pulverizing method in which a toner composition is melt-kneaded, finely pulverized and classified, have variation in their shape and surface structure. These shape and surface structure slightly vary depending on pulverization property of materials used and on the conditions for a pulverization step, and cannot be easily controlled as desired. Also, a toner having a narrower particle size distribution is difficult to produce in consideration of cost elevation and the limit of classification ability. In the case of pulverized toners, it is very important that their average particle diameter calculated from the particle size distribution thereof is small (in particular, 6 μm or smaller) in consideration of production yield, productivity and cost.

Meanwhile, spherical toner particles having a smaller particle diameter can be easily produced with a toner production method in which a toner composition is discharged from nozzles having small pore size, but nozzle clogging problematically arises in this method. Particularly when a toner containing a releasing agent (wax) is produced, coarse or aggregated wax particles in a toner composition easily cause nozzle clogging and thus, it is essential that the particle diameter of dispersed wax particles is desirably controlled.

In view of the above, demand has arisen for a toner production method in which a toner composition liquid is discharged from fine nozzles to form toner particles and which can efficiently produce a toner having a small particle diameter with very reduced fine powder; and for a toner, as produced with the toner production method, which causes no filming on a photoconductor, etc., is excellent in offset resistance and low-temperature fixing property, has a monodisperse particle size distribution which has not been attained with a conventional method, has very small variation in many characteristic values (e.g., flowability and chargeability), and can form a high-resolution, high-definition, high-quality image involving no degradation in image quality for a long period of time.

BRIEF SUMMARY OF THE INVENTION

In view of the foregoing, the present invention has been made to solve the above-described existing problems and aims to achieve the following objects. Specifically, an object of the present invention is to provide a toner production method which can efficiently produce a toner having a small particle diameter with considerably reduced fine powder. Another object of the present invention is to provide a toner produced with the toner production method which toner causes no filming on a photoconductor, etc., is excellent in offset resistance and low-temperature fixing property, has a monodisperse particle size distribution which has not been attained with a conventional method, has very small variation in many characteristic values (e.g., flowability and chargeability), and can form a high-resolution, high-definition, high-quality image involving no degradation in image quality for a long period of time.

Means for solving the above problems are as follows.

<1> A method for producing a toner, including:

periodically forming and discharging liquid droplets of a toner composition liquid containing at least a resin, a releasing agent and a colorant from a plurality of nozzles formed in a thin film which is provided in a reservoir for the toner composition liquid, by vibrating the thin film using a mechanically vibrating unit, and forming toner particles by solidifying the liquid droplets of the toner composition liquid, wherein the forming toner particles includes primarily drying the liquid droplets discharged from the nozzles of the thin film under a stream of dry gas containing an organic solvent whose partial pressure is equal to or higher than 1/10 of a saturated vapor pressure thereof but is equal to or lower than the saturated vapor pressure, the saturated vapor pressure being that at a drying temperature; and secondarily drying the primarily dried liquid droplets for solidification while the organic solvent is being evaporated.

<2> The method according to <1> above, wherein the organic solvent is a mixture of one or more organic solvents each having a boiling point of 45° C. to 120° C. at normal pressure.

<3> The method according to <2> above, wherein the organic solvent is at least one selected from ethyl acetate, acetone, ethyl alcohol, methyl ethyl ketone and toluene.

<4> The method according to <1> above, wherein the dry gas is fed at a velocity 3 times to 20 times that at which the liquid droplets are discharged from the nozzles of the thin film, in a direction in which the liquid droplets are discharged.

<5> The method according to <4> above, wherein the velocity at which the dry gas is fed is 5 times to 20 times that at which the liquid droplets are discharged.

<6> The method according to <3> above, wherein the organic solvent is ethyl acetate and the drying temperature in the primarily drying is 25° C. to 65° C.

<7> The method according to <6> above, wherein the secondarily drying is performed at a drying temperature of 55° C. to 110° C.

<8> The method according to <1> above, wherein the toner composition liquid to be discharged has the same temperature as the drying temperature in the primarily drying.

<9> The method according to <1> above, wherein the toner particles have a mass average particle diameter of 3 μm to 8 μm.

<10> The method according to <1> above, wherein a ratio of a mass average particle diameter of the toner particles to a number average particle diameter of the toner particles is 1.25 or less.

<11> The method according to <1> above, wherein a proportion of toner particles having a particle diameter of 12.7 μm or greater is 1% or less with respect to all the toner particles.

<12> The method according to <1> above, wherein the resin has a glass transition temperature of 35° C. to 80° C.

<13> The method according to <1> above, wherein the colorant is contained in the toner in an amount of 1% by mass to 15% by mass.

<14> The method according to <1> above, wherein the releasing agent is an acid-modified hydrocarbon wax.

<15> The method according to <1> above, wherein the releasing agent has an acid value of 1 KOHmg/g to 90 KOHmg/g.

<16> The method according to <1> above, wherein the releasing agent has a melt viscosity at 120° C. of 1.0 mPa·s to 30 mPa·s.

<17> The method according to <1> above, wherein the releasing agent has a melting point of 55° C. to 90° C.

<18> The method according to <1> above, wherein an amount of the releasing agent is 0.1 parts by mass to 20 parts by mass per 100 parts by mass of the resin.

<19> A toner obtained by the method according to <1> above.

<20> A developer including:

the toner according to <19> above, and a carrier.

The method of the present invention for producing a toner includes a periodically liquid droplet forming step of periodically forming and discharging liquid droplets of a toner composition liquid containing at least a resin, a releasing agent and a colorant from a plurality of nozzles formed in a thin film which is provided in a reservoir for the toner composition liquid, by vibrating the thin film using a mechanically vibrating unit, and a toner particle forming step of forming toner particles by solidifying the liquid droplets of the toner composition liquid, wherein the toner particle forming step includes a primarily drying step of primarily drying the liquid droplets discharged from the nozzles of the thin film under a stream of dry gas containing an organic solvent whose partial pressure is equal to or higher than 1/10 of a saturated vapor pressure thereof but is equal to or lower than the saturated vapor pressure, the saturated vapor pressure being that at a drying temperature; and a secondarily drying step of secondarily drying the primarily dried liquid droplets for solidification while the organic solvent is being evaporated.

In the method of the present invention for producing a toner, the partial vapor pressure of the organic solvent is defined when the liquid droplets of the toner composition liquid are periodically discharged from the nozzles of the thin film in the periodically liquid droplet forming step. Thus, even when the liquid droplets of the toner composition liquid are periodically discharged by the mechanically vibrating unit, no aggregated particles are formed since the discharged particles are not reduced in speed, and no nozzle clogging occurs. The present method, therefore, can efficiently produce a toner having a monodisperse particle size distribution which has not been attained with a conventional method.

The toner of the present invention is produced with the toner production method of the present invention and thus, is very advantageous in that it does not involve no or almost negligible variation in its particle size distribution unlike the case where conventional toner production methods for pulverized toners and chemical toners are used. Thus, the toner can consistently form a desired image even after repetitive development.

The present invention can provide a toner production method which can efficiently produce a toner having a small particle diameter with very reduced fine powder; and a toner produced with the toner production method which toner causes no filming on a photoconductor, etc., is excellent in offset resistance and low-temperature fixing property, has a monodisperse particle size distribution which has not been attained with a conventional method, has very small variation in many characteristic values (e.g., flowability and chargeability), and can form a high-resolution, high-definition, high-quality image involving no degradation in image quality for a long period of time. These can solve the existing problems.

Figure 1:
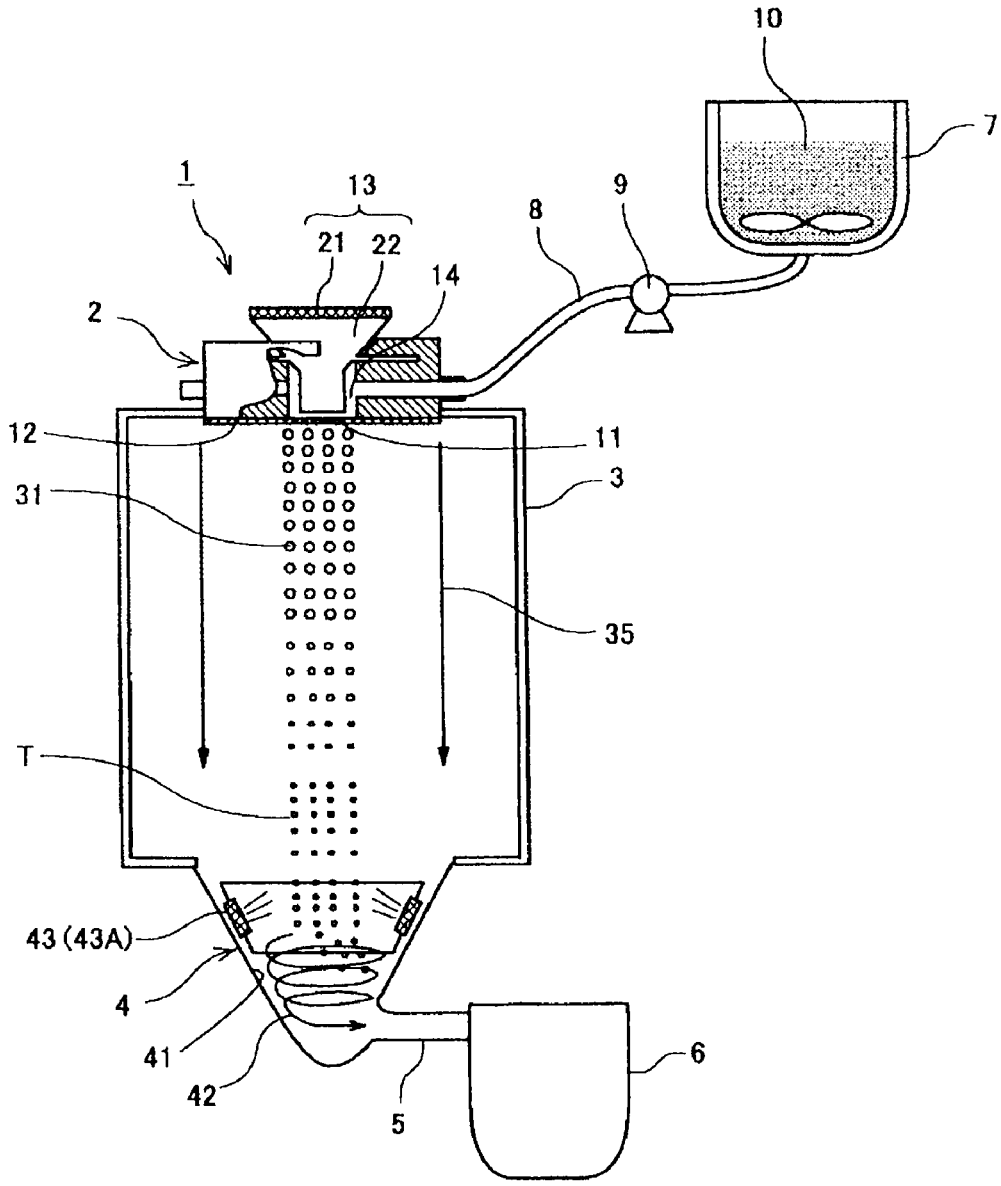
FIG. 1 schematically illustrates the configuration of a toner production apparatus used in the present invention, which employs a toner production method of the present invention.

DETAILED DESCRIPTION OF THE INVENTION (Toner and Method for Producing Toner)

A method of the present invention for producing a toner includes a periodically liquid droplet forming step and a toner particle forming step; and, if necessary, further includes other steps.

The toner particle forming step includes a primarily drying step of primarily drying liquid droplets discharged from nozzles of a thin film under a stream of dry gas containing an organic solvent whose partial pressure is equal to or higher than 1/10 of a saturated vapor pressure thereof but is equal to or lower than the saturated vapor pressure, the saturated vapor pressure being that at a drying temperature; and a secondarily drying step of secondarily drying the primarily dried liquid droplets for solidification while the organic solvent is being evaporated.

A toner of the present invention is obtained by the method of the present invention for producing a toner.

Next will be described in detail the present toner as well was the present method for producing a toner.

<Periodically Liquid Droplet Forming Step>

The periodically liquid droplet forming step is a step of periodically forming and discharging liquid droplets of a toner composition liquid containing at least a resin, a releasing agent and a colorant from a plurality of nozzles formed in a thin film which is provided in a reservoir for the toner composition liquid, by vibrating the thin film using a mechanically vibrating unit.

As a means for forming liquid droplets of the toner composition liquid in a vapor phase, the following are known: (1) a single-fluid spray nozzle (pressurization nozzle) designed to pressurize a liquid so as to be sprayed from a nozzle; (2) a multiple-fluid spray nozzle designed to spray a fluid in a state where a liquid and a pressurized gas are mixed; and (3) a rotation disc type sprayer designed to form liquid droplets by the action of centrifugal force brought by a rotating disc. In order to form a toner having a small particle diameter, a multiple-fluid spray nozzle and a rotation disc type sprayer are preferably used.

For the multiple-fluid spray nozzle as described in (2), external mix two-fluid spray nozzles are generally used. However, in order to form particles having a smaller particle diameter and a more uniform particle size distribution, various improvements have been made on multiple-fluid spray nozzles, as exemplified by internal mix two-fluid spray nozzles and four-fluid spray nozzles. To attain similar effects to the above, various improvements have been also made on the rotation disc type sprayer as described in (3), as exemplified by those formed into dish-shaped, bowl-shaped, multi-blade shape, etc.

However, a toner produced with any of these production methods has a relatively broad particle size distribution, and classification is required in some cases.

The present inventors made improvement on the toner production methods to overcome the existing problems, and have conceived a method in which liquid droplets of the toner composition liquid are periodically formed and discharged from a plurality of uniform nozzles of the thin film using a mechanically vibrating unit to produce a toner having a uniform particle size distribution. That is, an apparatus used in the toner production method of the present invention can form liquid droplets having a uniform particle diameter through discharging of a toner composition liquid (i.e., a solution or dispersion of toner materials containing at least a resin and a colorant) from a plurality of nozzles of a thin film, by using a liquid droplet forming unit which is a ring-shaped mechanically vibrating unit disposed around the nozzles or which is a mechanically vibrating unit having a vibrating surface disposed in parallel with the thin film, the vibrating surface vertically vibrating in a perpendicular direction to the thin film.

In the toner production method of the present invention, liquid droplets of a toner composition liquid are formed through discharging of the toner composition liquid from a plurality of nozzles of a thin film by mechanically vibrating the thin film. The mechanically vibrating unit may be set in any position, so long as it can vibrate in a perpendicular direction to the thin film having a plurality of nozzles. There are the following two modes employed in the present invention.

In one mode, there is used a mechanical unit (a mechanically vertically vibrating unit) having a vibrating surface disposed in parallel with a thin film having a plurality of nozzles and configured to vibrate in a perpendicular direction to the thin film (hereinafter this mode may be referred to as a "mode employing a horn vibrator"). In the other mode, there is used a circular mechanically vibrating unit (a ring-shaped mechanically vibrating unit) disposed on the thin film so as to surround an area where a plurality of nozzles are arranged (hereinafter this mode may be referred to as a "mode employing a ring-shaped vibrator).

-Mechanically Vertically Vibrating Unit-

With reference to a schematic configuration of FIG. 1, first will be described a toner production apparatus employing the mechanically vertically vibrating unit.

A toner production apparatus 1 includes a liquid droplet jetting unit 2 serving as a liquid droplet forming unit, a particle forming section (solvent removing section) 3 serving as a particle forming unit, a toner collecting section 4, a tube 5, a toner reservoir 6 serving as a toner reserving unit, a material accommodating unit 7 for accommodating a toner composition liquid 10, a liquid feeding pipe 8, and a pump 9. In this apparatus, the liquid droplet jetting unit 2 is configured to discharge liquid droplets of a toner composition liquid containing at least a resin, a releasing agent and a colorant; the particle forming section 3 is disposed below the liquid droplet jetting unit 2 and forms toner particles by solidifying liquid droplets of the toner composition liquid which are discharged from the liquid droplet jetting unit 2; the toner collecting section 3 collects the toner particles formed in the particle forming section 3; the toner reservoir 6 reserves the toner particles transferred via the tube 5 from the toner collecting section 4; the material accommodating unit 7 contains the toner composition liquid 10; the liquid feeding pipe 8 feeds the toner composition liquid 10 from the material accommodating unit 7 to the liquid droplet jetting unit 2; and the pump 9 pressure-feeds the toner composition liquid 10 upon operation of the toner production apparatus 1.

During operation of the toner production apparatus, the toner composition liquid 10 sent from the material accommodating unit 7 can be self-supplied to the liquid droplet jetting unit 2 by virtue of the liquid droplet forming phenomenon brought by the liquid droplet jetting unit 2 and thus, the pump 9 is subsidiarily used for liquid supply. Notably, the toner composition liquid 10 used in this apparatus is a solution/dispersion prepared by dissolving/dispersing, in a solvent, toner materials containing at least a resin, a releasing agent and a colorant.

Figure 2:
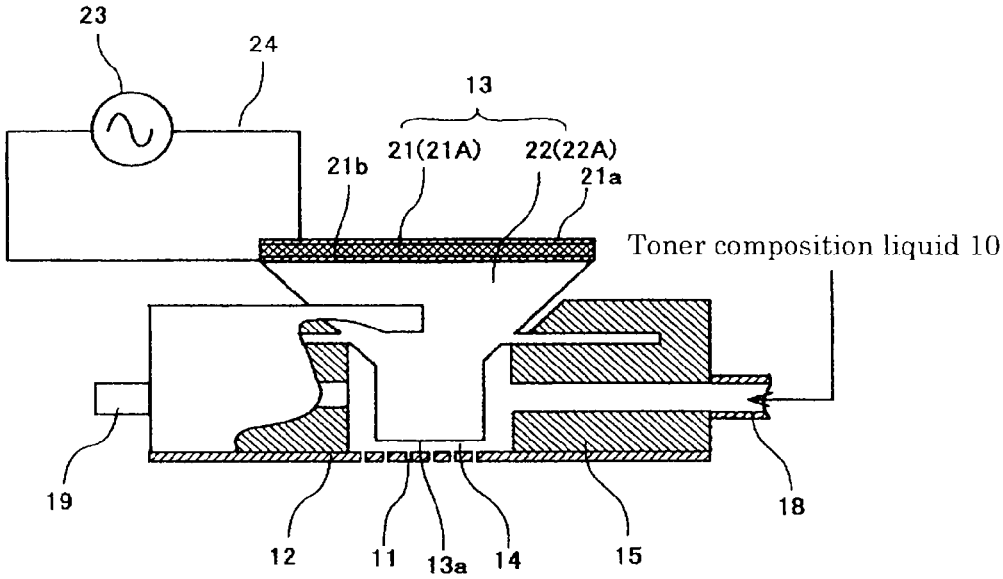
FIG. 2 is an enlarged explanatory view of a liquid droplet jetting unit of the toner production apparatus illustrated in FIG. 1.
Figure 3:
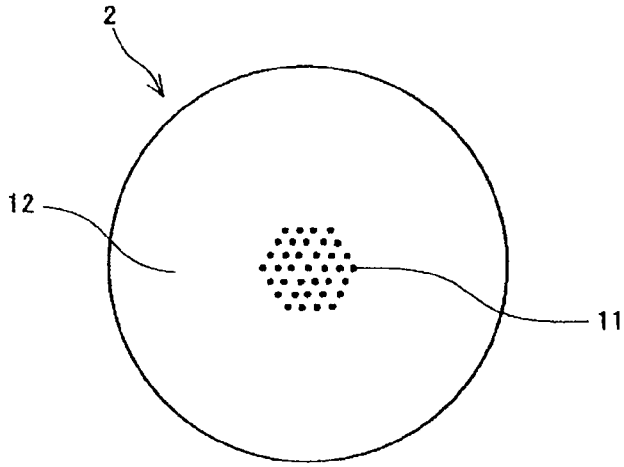
FIG. 3 is a bottom view of the liquid droplet jetting unit illustrated in FIG. 2, as viewed from the underside.

Next will be described the liquid droplet jetting unit 2 with reference to FIGS. 2 and 3. FIG. 2 is a schematic explanatory cross-sectional view of the liquid droplet jetting unit 2; and FIG. 3 is a bottom view of an essential part of the liquid droplet jetting unit 2 shown in FIG. 2, as viewed from the underside.

This liquid droplet jetting unit 2 includes a thin film 12 having a plurality of nozzles (ejection holes) 11, a mechanically vibrating unit (hereinafter may be referred to as a "vibrating unit") 13 for vibrating the thin film 12, and a flow passage member 15 forming a reservoir (flow passage) 14 from which the toner composition liquid 10 containing at least a resin, a releasing agent and a colorant is fed to a space between the thin film 12 and the vibrating unit 13.

The thin film 12 having a plurality of nozzles 11 is placed in parallel with a vibrating surface 13*a* of the vibrating unit 13, and part of the thin film 12 is joined or fixed on the flow passage member 15 with solder or a binder resin insoluble in the toner composition liquid 10. In this state, the thin film 12 is positioned substantially perpendicular to a direction in which the vibrating unit 13 is vibrated. A communication unit 24 is provided such that a voltage signal is applied to the top and under surfaces of a vibration generating unit 21 in the vibrating unit 13, and can covert signals received from a drive signal generation source 23 into a mechanical vibration. As the communication unit 24 for giving electric signals, a lead wire whose surface has subjected to insulating coating is suitable. For the vibrating unit 13, it is advantageous, in order to efficiently and stably producing a toner, to use a device exhibiting a large vibration amplitude such as various types of horn-type vibrator and bolting Langevin transducer.

The vibrating unit 13 is composed of the vibration generating unit 21 configured to generate a vibration, and a vibration amplifying unit 22 configured to amplify the vibration generated by the vibration generating unit 21. In this vibrating unit 13, when a drive voltage having a required frequency (drive signal) is applied to between electrodes 21*a* and 21*b* of the vibration generating unit 21 from the drive signal generation source (drive circuit) 23, a vibration is excited in the vibration generating unit 21 and then the vibration is amplified by the vibration amplifying unit 22. In this state, the vibrating surface 13*a* placed in parallel with the thin film 12 is periodically vibrated, and the thin film 12 is vibrated at a required frequency by periodically applied pressure brought by the vibration of the vibrating surface 13*a*.

The vibrating unit 13 is not particularly limited, so long as it can assuredly vertically vibrate the thin film 12 at a constant frequency, and can be appropriately selected depending on the purpose. As the vibration generating unit 21, there is a need to vibrate the thin film 12, and therefore a bimorph-type piezoelectric element 21A is preferable. The bimorph-type piezoelectric element 21A can excite flexural oscillation and convert electric energy into mechanical energy. Specifically, it can excite flexural oscillation through application of a voltage to vibrate the thin film 12.

Examples of the piezoelectric element 21A composing the vibration generating unit 21 include piezoelectric ceramics such as lead zirconium titanate (PZT). The piezoelectric ceramics generally exhibit a small displacement and thus, are often used in a form of laminate. Further examples include piezoelectric polymers such as polyvinylidene fluoride (PVDF); quartz crystal; and single crystals such as $LiNbO_3$, $LiTaO_3$ and $KNbO_3$.

The vibrating unit 13 may be set in any position, so long as it can vertically vibrate the thin film 12 having nozzles 11. The vibrating surface 13*a* is placed in parallel with the thin film 12.

In the illustrated example, a horn vibrator is used as the vibrating unit 13 composed of the vibration generating unit 21 and the vibration amplifying unit 22. This horn vibrator can amplify the amplitude of a vibration generated from the vibration generating unit 21 (e.g., a piezoelectric element) using a horn 22A serving as the vibration amplifying unit 22 and thus, an initial vibration generated by the vibration generating unit 21 is allowed to be relatively small. Therefore, the mechanical load can be reduced, resulting in extending the service life of the production apparatus.

Figure 4:
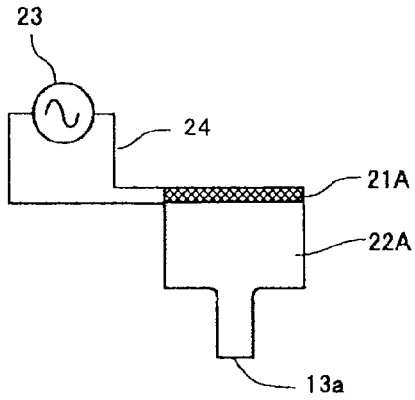
FIG. 4 is a schematic explanatory view of a step-shaped horn vibrator.
Figure 5:
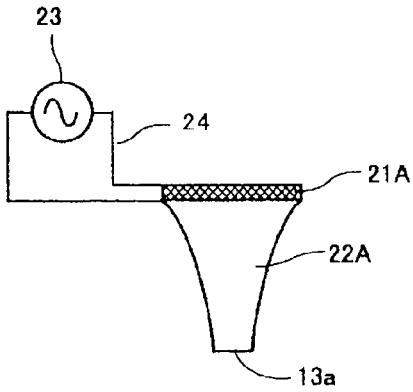
FIG. 5 is a schematic explanatory view of an exponential-shaped horn vibrator.
Figure 6:
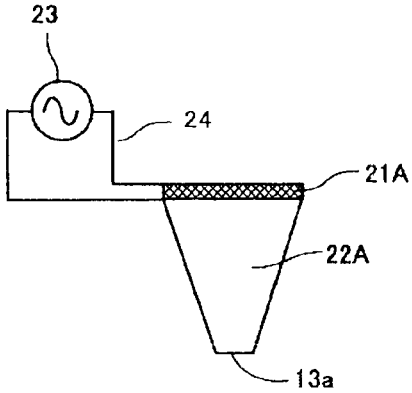
FIG. 6 is a schematic explanatory view of a conical horn vibrator.

The horn vibrator is not particularly limited and may be those having a generally known shape. Specific examples include step-horn vibrators (shown in FIG. 4), exponential-horn vibrators (shown in FIG. 5), and conical vibrators (shown in FIG. 6). In each of these horn vibrators, a piezoelectric element 21A is set on a larger surface of the horn 22A, and a smaller surface of the horn 22A serves as a vibrating surface 13*a*. The piezoelectric element 21A is vertically vibrated and then, the generated vibration is effectively amplified with the horn 22A which is designed so that the vibration amplified becomes the greatest at the vibrating surface 13*a*. Also, a lead wire 24 is connected to the piezoelectric element 21A at its top and under surfaces, and a drive circuit 23 applies alternating current voltage signals via the lead wire to the piezoelectric element 21A. These horn vibrators are designed so that a vibration becomes the greatest at the vibrating surface 13*a*.

Further, as the vibrating unit 13, it is also possible to use a bolting Langevin transducer having very high mechanical strength. Even when a high-amplitude vibration is excited, the bolting Langevin transducer will not be broken since a piezoelectric ceramics is mechanically connected thereto.

With reference to a schematic view illustrated in FIG. 2, next will be described in detail the configurations of the reservoir, the mechanically vibrating unit, and the thin film. The reservoir 14 is provided with a liquid feeding tube 18 at one or more sites thereof. As shown in a partial cutaway portion in FIG. 2, a liquid is fed to the reservoir 14 through a flow passage. Further, the reservoir 14 may optionally be provided with an air bubble discharge tube 19. The liquid droplet jetting unit 2 is set and held on the top surface of the particle forming section 3 by an unillustrated support member mounted to the flow passage member 15. Note that the above-described toner production apparatus has the liquid droplet jetting unit 2 placed on the top surface of the particle forming section 3. Alternatively, the toner production apparatus may have such a configuration that the liquid droplet jetting unit 2 is placed on a side wall surface or the bottom of a drying unit which is the particle forming section 3.

In general, the size of the vibrating unit 13 which generates a mechanical vibration increases in accordance with decreasing of the number of vibrations generated. In consideration of the frequency required, the vibrating unit may be directly perforated to form a reservoir. In this case, it is possible to vibrate the entire reservoir with efficiency. Note that the "vibrating surface" is defined as a surface on which the thin film having a plurality of nozzles is laminated.

Figure 7:
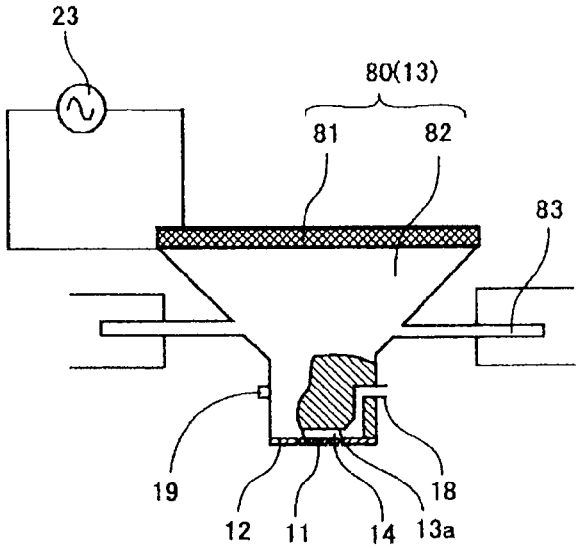
FIG. 7 is an enlarged explanatory view of another liquid droplet jetting unit used in the toner production apparatus.

Variant examples of the liquid droplet jetting unit 2 having such a configuration will be described below with reference to FIGS. 7 and 8. A liquid droplet jetting unit shown in FIG. 7 includes a horn vibrator 80 composed of a piezoelectric element 81 serving as a vibration generating unit and a horn 82 serving as a vibration amplifying unit, wherein the horn vibrator 80 serves as the vibrating unit 13 and a reservoir (flow passage) 14 is formed at part of the horn 82. This liquid droplet jetting unit 2 is preferably fixed on a wall surface of a particle forming section (drying unit) 3 with a fixing part (flange part) 83 which is united with the horn 82 of the horn vibrator 80. Alternatively, the liquid droplet jetting unit 2 may be fixed using an unillustrated elastic material for the purpose of preventing vibration loss.

Figure 8:
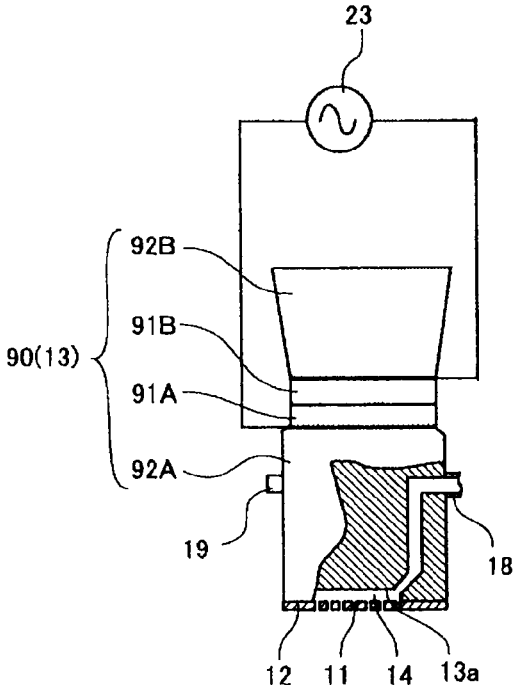
FIG. 8 is an enlarged explanatory view of still another liquid droplet jetting unit used in the toner production apparatus.

A liquid droplet jetting unit shown in FIG. 8 includes a bolting Langevin vibrator 90 serving as the vibrating unit 13. The bolting Langevin vibrator 90 is composed of piezoelectric elements 91A and 91B each serving as a vibration generating unit and horns 92A and 92B mechanically and tightly fixed by bolting. In this vibrator, a reservoir (flow passage 14) is formed inside the horn 92A. The size of a piezoelectric element may be large depending on the frequency conditions. In this case, fluid feeding/discharging passages and a reservoir are formed in the vibrator as shown in this figure, and a metal thin film composed of a plurality of thin films may be attached thereto.

The toner production apparatus shown in FIG. 1 has only one liquid droplet jetting unit 2 on the particle forming section 3. From the viewpoint of improving productivity, a plurality of liquid droplet jetting units 2 are arranged in parallel on the top portion of the particle forming section 3 (drying tower). The number of liquid droplet jetting units 2 is preferably 100 to 1,000 from the viewpoint of controllability. In this case, each of the liquid droplet jetting units 2 is designed so that a toner composition liquid 10 is supplied from the material accommodating unit (common liquid reservoir) 7 via the liquid feeding pipe 8 to each reservoir 14. The toner composition liquid 10 may be self-supplied or may be supplied using the pump 9 subsidiarily during operation of the toner production apparatus.

Figure 9:
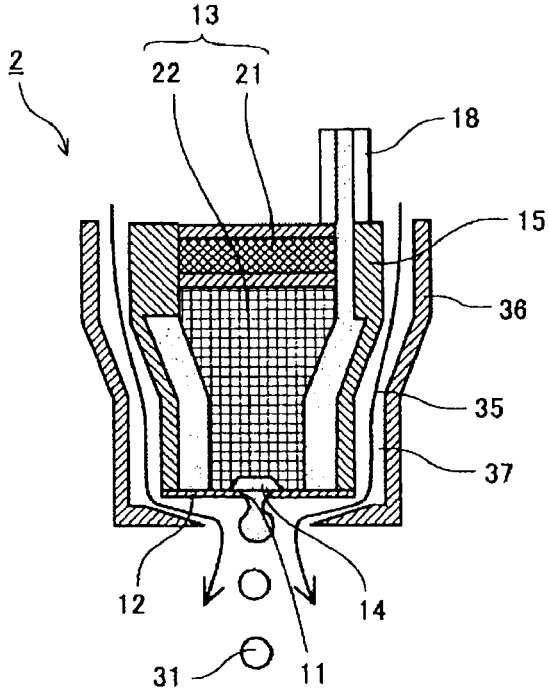
FIG. 9 is an enlarged explanatory view of yet another liquid droplet jetting unit used in the toner production apparatus.

With reference to FIG. 9, another liquid droplet jetting unit will be described below. FIG. 9 is an explanatory cross-sectional view of the liquid droplet jetting unit.

Similar to the above-described liquid droplet jetting units, this liquid droplet jetting unit 2 includes a horn vibrator serving as the vibration generating unit 13. In this liquid droplet jetting unit, a flow passage member 15 for supplying a toner composition liquid 10 is provided so as to surround the vibration generating unit 13, and a reservoir 14 is formed in a horn 22 of the vibration generating unit 13 so as to face a thin film 12. Further, an airflow passage 37 through which an airflow 35 passes is formed between the flow passage member 15 and an airflow passage forming member 36. For the sake of convenience, the thin film 12 having only one nozzle 11 is shown in FIG. 9, but a plurality of nozzles are actually formed as described above.

Figure 10:
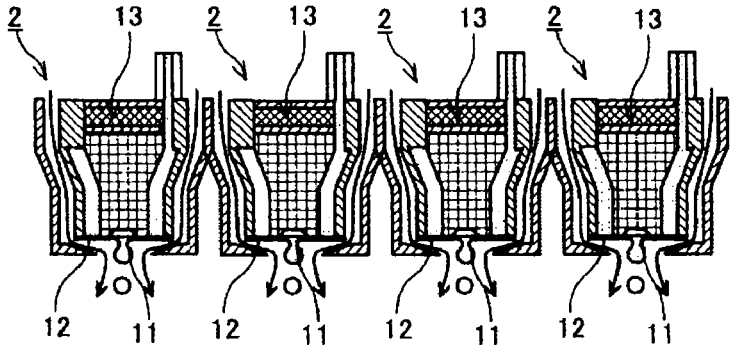
FIG. 10 is an explanatory view of a plurality of liquid droplet jetting units shown in FIG. 9 arranged in a row.

Furthermore, as shown in FIG. 10, a plurality of liquid droplet jetting units—100 to 1,000 liquid droplet jetting units 2 from the viewpoint of, for example, controllability—are arranged on the top surface of a drying tower composing the particle forming section 3. With this configuration, productivity of a toner can be further improved.

(Ring-Shaped Mechanically Vibrating Unit)

Figure 11:
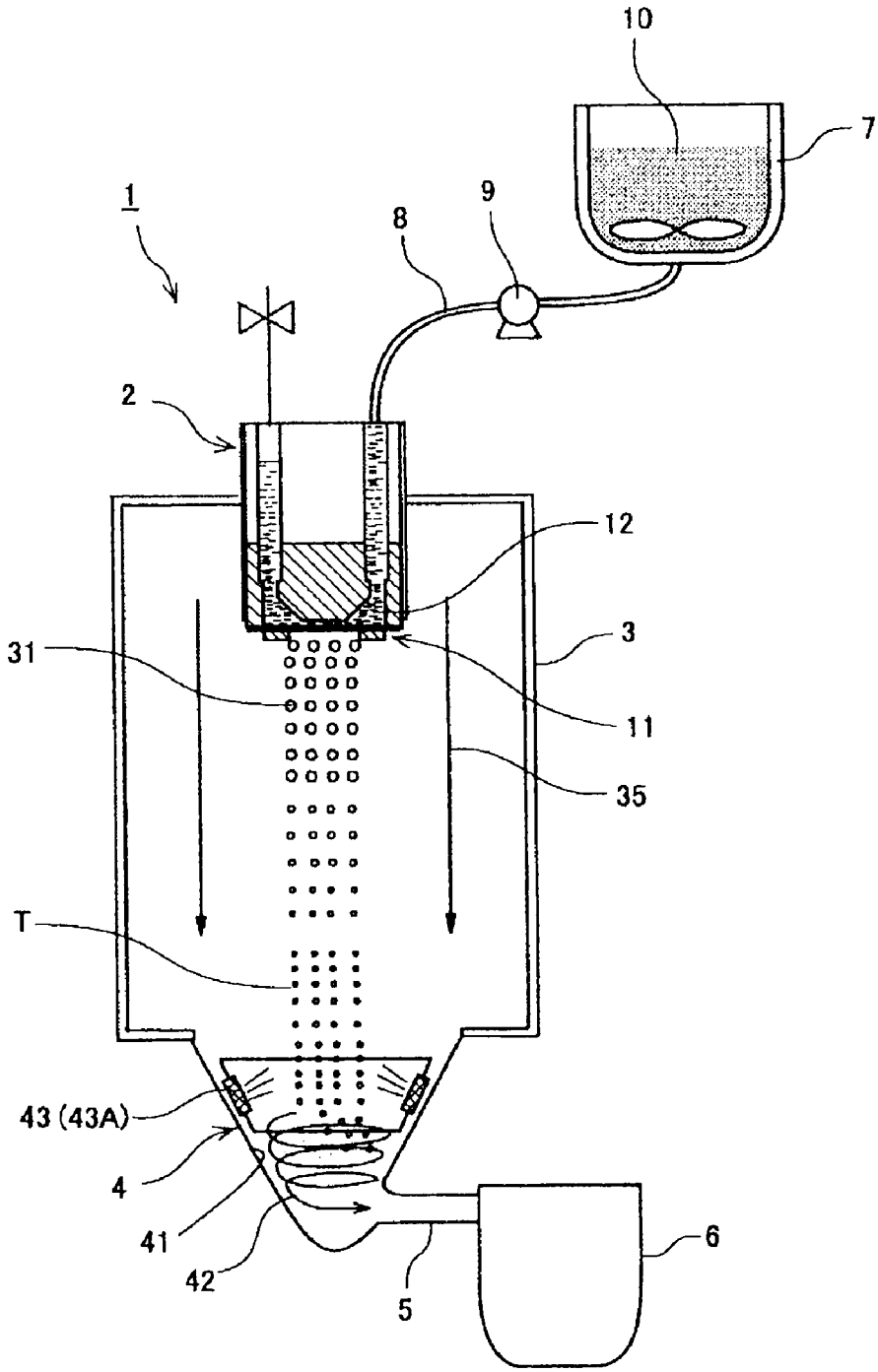
FIG. 11 schematically illustrates the configuration of a toner production apparatus according to one embodiment in the present invention, which employs a toner production method of the present invention.

A toner production apparatus shown in FIG. 11 is the same as that shown in FIG. 1, except that a ring-shaped liquid droplet jetting unit is used.

Figure 12:
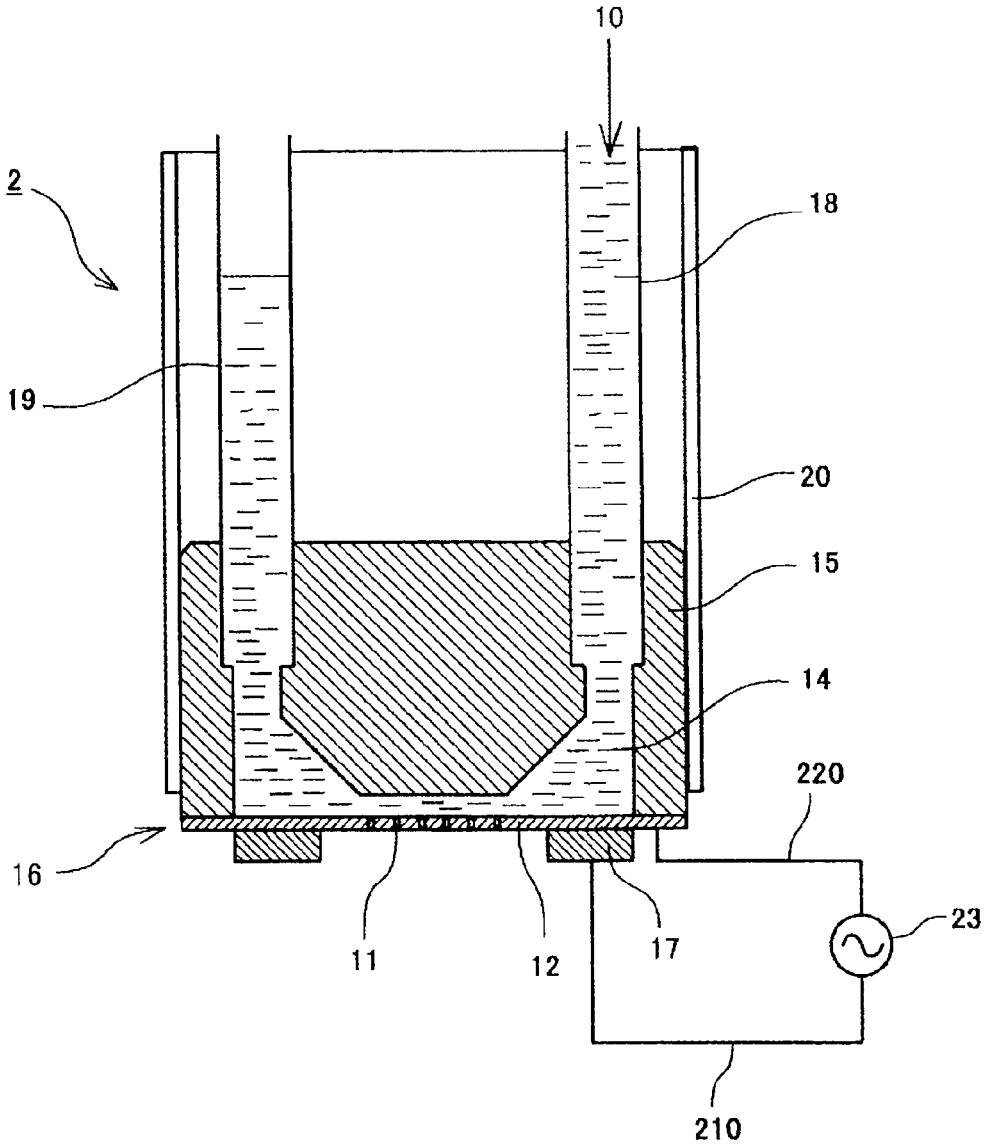
FIG. 12 is an enlarged explanatory view of a liquid droplet jetting unit of the toner production apparatus.
Figure 13:
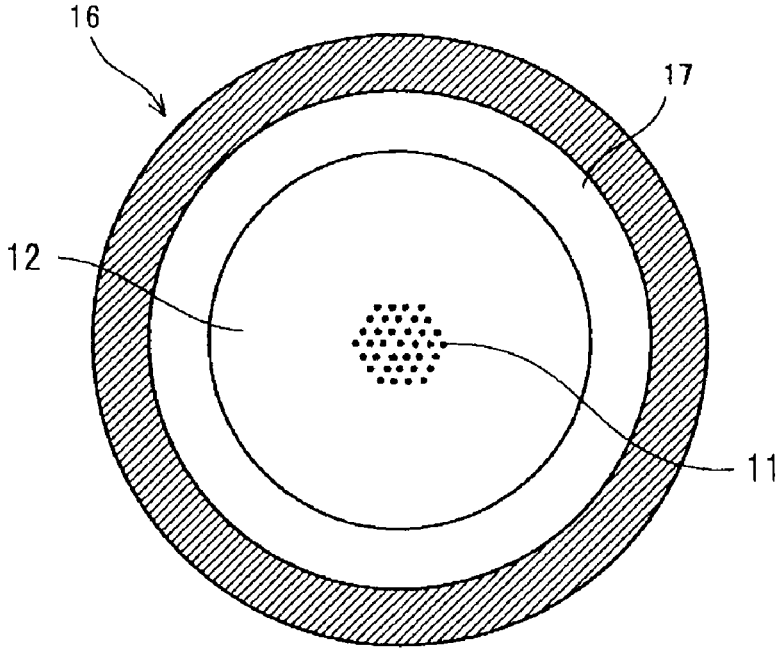
FIG. 13 is a bottom view of the liquid droplet jetting unit illustrated in FIG. 12, as viewed from the underside.
Figure 14:
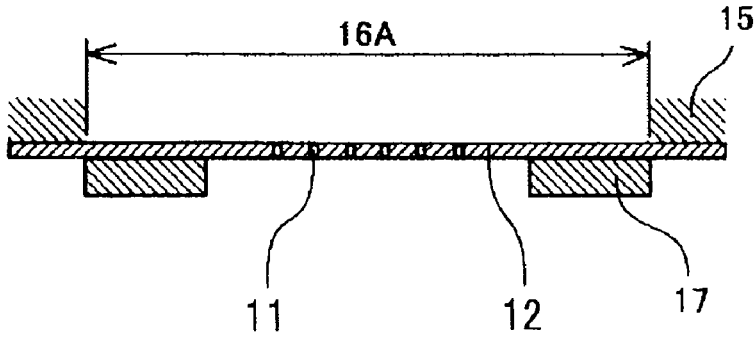
FIG. 14 is an enlarged, explanatory cross-sectional view of a liquid droplet forming unit of the liquid droplet jetting unit.

Next will be described a liquid droplet jetting unit 2 with reference to FIGS. 12 to 14. FIG. 12 is an explanatory cross-sectional view of the liquid droplet jetting unit 2; FIG. 13 is a bottom view of the production apparatus shown in FIG. 12, as viewed from the underside; and FIG. 14 is an explanatory schematic cross-sectional view of the liquid droplet forming unit.

This liquid droplet jetting unit 2 includes a liquid droplet forming unit 16 and a flow passage member 15, wherein the liquid droplet forming unit 16 is configured to discharge droplets of the toner composition liquid 10 containing at least a resin, a releasing agent and a colorant, and the flow passage member 15 has a reservoir (flow passage) 14 for supplying the toner composition liquid 10 to the liquid droplet forming unit 16.

The liquid droplet forming unit 16 has a thin film 12 having a plurality of nozzles (ejection holes) 11 and a ring-shaped vibration generating unit (electromechanical transducing unit) 17 configured to vibrate the thin film 12. Here, the thin film 12 is joined or fixed at its outermost peripheral area (shaded area in FIG. 13) on the flow passage member 15 with solder or a binder resin insoluble in the toner composition liquid. The vibration generating unit 17 is disposed in a deformable area 16A (i.e., area where the flow passage member 15 is not fixed) of the thin film 12 so as to be along a circumference of the area. The vibration generating unit 17 is connected via lead wires 210 and 220 to a drive circuit (drive signal generating source) 23, and when a drive voltage (drive signal) having a required frequency is applied, it generates, for example, deflection vibration.

Figure 15:
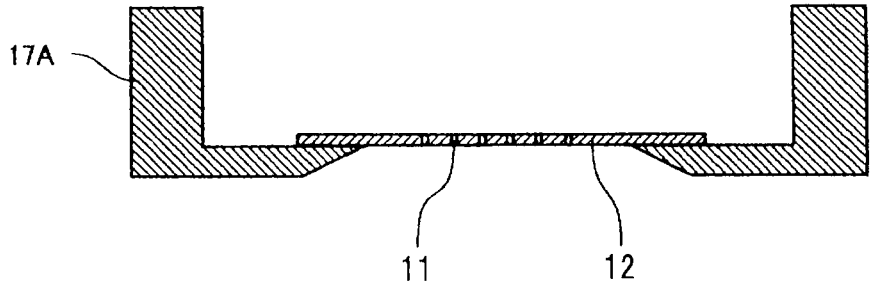
FIG. 15 is an enlarged, explanatory cross-sectional view of a comparative liquid droplet forming unit.

As described above, the liquid droplet forming unit 16 includes the thin film 12 having a plurality of nozzles 11 facing the reservoir 14, and the ring-shaped vibration generating unit 17 disposed in the deformable area 16A so as to surround nozzles of the thin film 12. When the liquid droplet forming unit 16 has such a configuration, as compared with, for example, the comparative configuration shown in FIG. 15 where a vibration generating unit 17A supports the periphery of the thin film 12, the displacement of the thin film 12 is relatively large. With this configuration, a plurality of nozzles 11 can be disposed in a relatively large area (1 mm or greater in diameter) where a large displacement can be obtained and thus, a large number of liquid droplets can be reliably discharged at one time from the nozzles 11.

Figure 16:
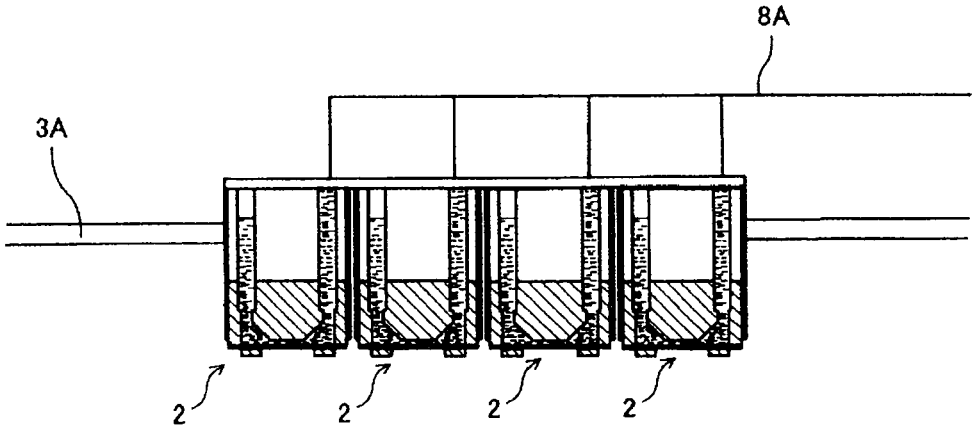
FIG. 16 is an explanatory view of essential parts of the toner production apparatus, which is referred to for specifically describing application of the toner production apparatus.

The toner production apparatus shown in FIG. 11 has one liquid droplet jetting unit 2. Preferably, as shown in FIG. 16, a plurality of liquid droplet jetting units 2 (e.g., 100 to 1,000 liquid droplet jetting units in terms of controllability (in FIG. 16, four liquid droplet jetting units are illustrated)) are disposed in a row to the top surface 3A of the particle forming section 3, and the liquid droplet jetting units 2 are each connected via a pipe 8A to the material accommodating unit 7 (common liquid reservoir) so that the toner composition liquid 10 is supplied thereto. With this configuration, a larger number of liquid droplets 31 can be discharged at one time, resulting in improving production efficiency.

-Mechanism of Liquid Droplet Formation-

Next will be described a mechanism of liquid droplet formation by the liquid droplet jetting unit 2 serving as a liquid droplet forming unit.

As described above, the liquid droplet jetting unit 2 applies a vibration generated by the vibrating unit 13 serving as a mechanically vibrating unit to the thin film 12 having a plurality of nozzles 11 facing the reservoir 14 to periodically vibrate the thin film 12, whereby liquid droplets 31 are reliably discharged from a plurality of nozzles 11 disposed in a relatively large area (1 mm or greater in diameter).

Figure 17A:
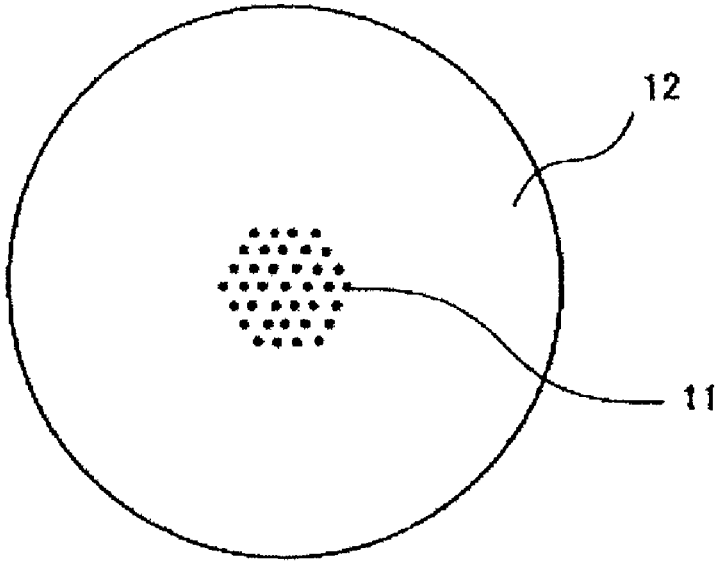
FIG. 17A is a schematic explanatory view of a thin film, which is referred to for describing the mechanism of liquid droplet formation by the liquid droplet jetting unit.
Figure 17B:
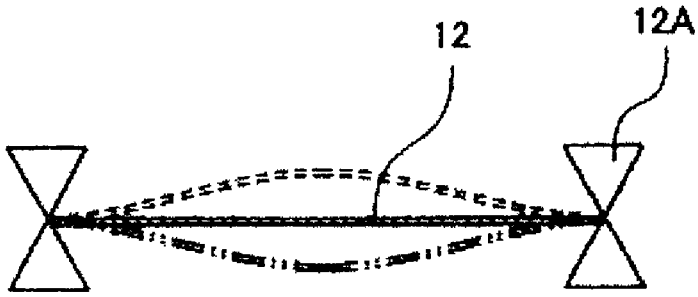
FIG. 17B is a schematic explanatory view of a thin film, which is referred to for describing the mechanism of liquid droplet formation by the liquid droplet jetting unit.
Figure 18:
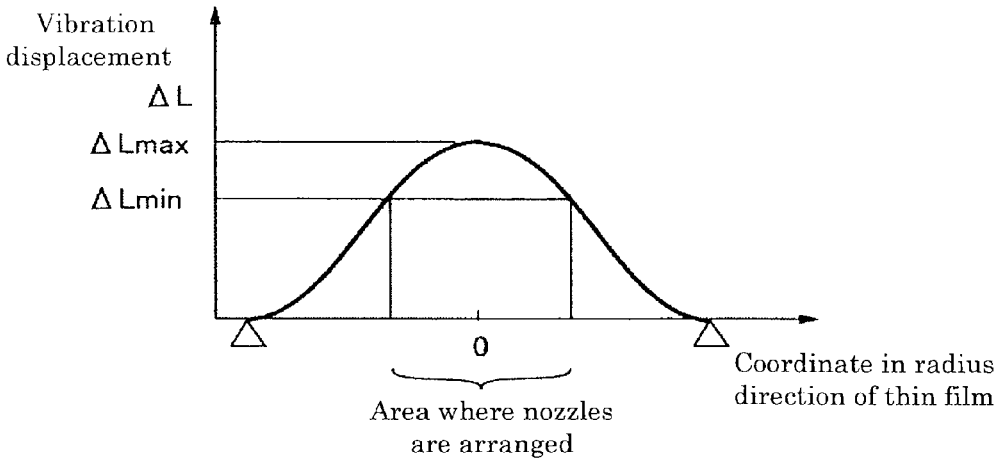
FIG. 18 is a graph referred to for describing a basic vibration mode.

When the thin film 12 having a simple round-shape as shown in FIGS. 17A and 17B is fixed at its peripheral area 12A, a basic vibration occurring upon vibration has a node at the peripheral area. As shown in FIG. 18, the maximum displacement ΔLmax is observed at a center portion O, and the thin film 12 is periodically vibrated in a vertical direction.

Figure 19:
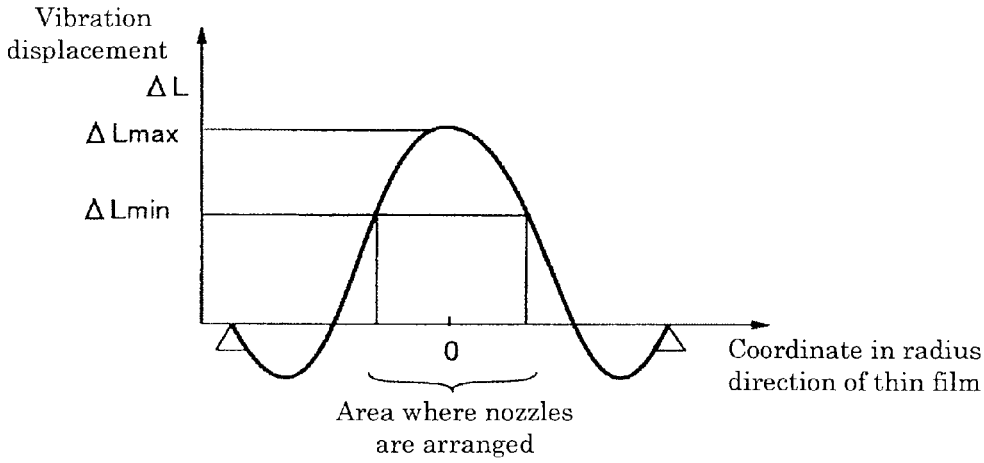
FIG. 19 is a graph referred to for describing a secondary vibration mode.
Figure 20:
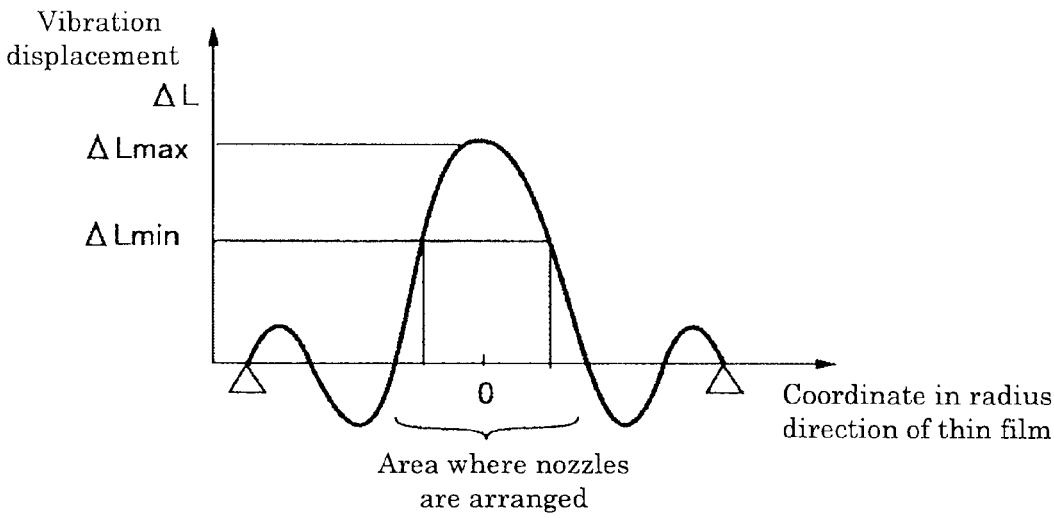
FIG. 20 is a graph referred to for describing a tertiary vibration mode.
Figure 21:
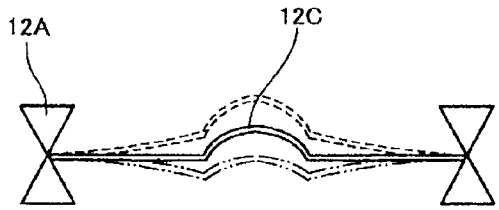
FIG. 21 is an explanatory view of a thin film having a convex portion at its center portion.

Notably, there have been known higher-order vibration modes shown in FIGS. 19 and 20. In these modes, one or more nodes are concentrically formed in the circular thin film 12, and this thin film substantially transforms axisymmetrically. Also, use of the circular thin film 12 having a convex portion 12*c* at its center portion (shown in FIG. 21) can control the vibration amplitude and the movement direction of liquid droplets.

When the circular thin film is vibrated, a sound pressure of Pac is applied to the liquid present in the vicinity of the nozzles formed in the circular thin film. This Pac is proportional to a vibration speed Vm of the circular thin film. This sound pressure is known to arise as a result of reaction of a radiation impedance Zr of the medium (toner composition liquid), and is expressed by multiplying the radiation impedance by the film vibration speed Vm, as shown in the following Equation (1).

$$P_{ac}(r,t)=Z_r\cdot V_m(r,t) \qquad \text{Equation (1)}$$

The film vibration speed Vm periodically varies with time (i.e., is a function of time) and may form various periodic variations (e.g., a sine waveform and rectangular waveform). Also, as described above, the vibration displacement in a vibration direction varies depending on a position in the thin film (i.e., the vibration speed Vm is also a function of a position). As mentioned above, the vibration form of the thin film used in the present invention is axisymmetric. Thus, the vibration form is substantially a function of a radial coordinate.

The toner composition liquid is discharged to a gaseous phase by the action of the sound pressure periodically changing proportional to the position-dependent film vibration speed.

Then, the toner composition liquid 10, which has been periodically discharged to the gaseous phase, becomes spherical attributed to the difference in surface tension between in the liquid phase and in the gaseous phase, whereby liquid droplets thereof are periodically discharged.

In order to form liquid droplets, the thin film 16 may be vibrated at a vibration frequency of 20 kHz to 2.0 MHz, preferably 50 kHz to 500 kHz. When the vibration frequency is 20 kHz or higher, dispersibility of microparticles (e.g., pigment and/or wax particles) contained in the toner composition liquid is promoted through excitation of the toner composition liquid.

Also, when the sound pressure is 10 kPa or higher, dispersibility of the above microparticles is further promoted.

Here, the larger the vibration displacement of the film in an area in the vicinity of the nozzles, the larger the diameter of the liquid droplets formed. Meanwhile, when the vibration displacement of the film in an area in the vicinity of the nozzles is small, the formed liquid droplets become small or no liquid droplets are formed. In order to reduce such variation in size of the liquid droplets, the nozzles must be formed in optimal positions determined in consideration of the vibration displacement of the thin film.

Also, in the present invention, in the case where the film is vibrated with the mechanical vibrating unit, when nozzles are formed within an area where the ratio R ($\Delta L_{max}/\Delta L_{min}$) of the maximum vibration displacement $\Delta L_{max}$ in the vicinity of nozzles to the minimum vibration displacement $\Delta L_{min}$ in the vicinity of nozzles is 2.0 or lower (as shown in FIGS. 18 to 20), variation in size of the liquid droplets is reduced to such an extent that the formed toner particles can provide a high quality image.

As a result of experiments performed by changing the conditions for toner composition liquid, it was found that a range of conditions where a viscosity is set to 20 mPa·s or less and a surface tension is set to 20 mN/m to 75 mN/m is similar to a range of conditions where satellite liquid droplets begin to take place. Thus, the sound pressure is preferably 500 kPa or lower, more preferably 100 kPa or lower.

-Thin Film Having a Plurality of Nozzles-

As described above, the thin film 12 having a plurality of nozzles is a member for discharging, in the form of liquid droplet, a solution or dispersion (toner composition liquid) of toner materials containing at least a resin, a releasing agent and a colorant.

The material of the thin film 12 and the shape of the nozzles 11 are not particularly limited and can be appropriately selected. Preferably, the thin film 12 is formed of a metal plate having a thickness of 5 μm to 500 μm and the nozzles 11 each have a pore size of 3 μm to 35 μm, from the viewpoint of forming liquid microdroplets having a very uniform particle diameter when liquid droplets of the toner composition liquid 10 are discharged from the nozzles 11. Note that when the nozzles 11 each have a truly circular shape, the pore size is the diameter thereof. Meanwhile, when the nozzles 11 each have an ellipsoidal shape, the pore size is the minor axis thereof. The number of nozzles 11 is preferably 2 to 3,000.

<Toner Particle Forming Step>

The toner particle forming step is a step of forming toner particles by solidifying the liquid droplets of the toner composition liquid.

The toner particle forming step includes a primarily drying step of primarily drying liquid droplets discharged from nozzles of a thin film under a stream of dry gas containing an organic solvent whose partial pressure is equal to or higher than 1/10 of a saturated vapor pressure thereof but is equal to or lower than the saturated vapor pressure, the saturated vapor pressure being that at a drying temperature; and a secondarily drying step of secondarily drying the primarily dried liquid droplets for solidification while the organic solvent is being evaporated.

The dry gas refers to gas whose dew-point temperature is −10° C. or lower at atmospheric pressure.

The dry gas is not particularly limited, so long as it can dry liquid droplets. Preferred examples thereof include air and nitrogen gas.

The drying step of removing the organic solvent from liquid droplets is performed by discharging the liquid droplets into gas such as heated dry nitrogen. In the liquid droplet forming step, the liquid droplets are generally discharged at a velocity of 10 m/sec or less and, at the same time, their velocity decreases due to air resistance. In some cases, previously discharged undried particles are caught up with subsequently discharged particles to form aggregated particles, resulting in that the formed particles do not have a uniform particle size distribution. In order to avoid such an unfavorable phenomenon, it is necessary that liquid droplets are dried using a large amount of dry gas immediately after discharging of them. But, an impractical, large amount of gas is required to prevent formation of aggregated particles. In an alternative solution, particles immediately after discharging are accelerated to such an extent that they are not caught up with subsequently discharged particles. Specifically, in this solution, the velocity at which a dry gas is fed immediately after discharging of particles is adjusted to be 3 times or more that at which the particles are discharged. However, in either case, surfaces from which particles are discharged (nozzle surfaces) are rapidly dried by dry gas, potentially causing nozzle clogging.

In view of the above, in order to form a toner having a sharp particle size distribution, the toner particle forming step is divided into a primarily drying step and a secondarily drying step. Specifically, in the former step, discharged particles are accelerated with less solvent evaporation to a velocity at which they are not aggregated with subsequently discharged particles; and, in the latter step, sufficiently accelerated particles are dried.

In the primarily drying step, the partial pressure of the organic solvent is equal to or higher than 1/10 of a saturated vapor pressure thereof but is equal to or lower than the saturated vapor pressure, the saturated vapor pressure being that at a drying temperature. Preferably, the partial pressure of the organic solvent is equal to or higher than 1/8 of the saturated vapor pressure but is equal to or lower than the saturated vapor pressure. More preferably, the partial pressure of the organic solvent is equal to or higher than 1/5 of the saturated vapor pressure but is equal to or lower than the saturated vapor pressure. When the partial pressure is lower than 1/10 of the saturated vapor pressure, the drying rate cannot be adjusted. The partial pressure exceeding the saturated vapor pressure is impractical.

Also, in the primarily drying step, the dry gas is preferably fed at a velocity 3 times to 20 times that at which liquid droplets are discharged from nozzles of the thin film, in the direction in which the liquid droplets are discharged. More preferably, the dry gas is fed at a velocity 5 times to 20 times that at which liquid droplets are discharged from nozzles of the thin film. When the dry gas is fed at a velocity less than 3 times that at which liquid droplets are discharged from nozzles of the thin film, the discharged particles are not satisfactorily accelerated to form aggregated particles, resulting in that the formed particles do not have a uniform particle size distribution. When the dry gas is fed at a velocity 20 times or more that at which liquid droplets are discharged from nozzles of the thin film, uniform particles are formed immediately after liquid droplet formation but some of them are disintegrated due to the difference between the rates to generate fine powder, whereby the object of the present invention cannot be achieved.

In the primarily drying step, use of one or more organic solvents each having a boiling point at normal pressure of 45° C. to 120° C. is preferred from the viewpoints of productivity and energy saving. The organic solvent having a boiling point at normal pressure of lower than 45° C. is highly volatile at ambient temperature, potentially making it difficult to control drying. The organic solvent having a boiling point at normal pressure of higher than 120° C. requires a large amount of energy for drying, potentially being an obstacle to energy-saving production.

The organic solvent is not particularly limited, so long as it has a boiling point at normal pressure of 45° C. to 120° C., and may be appropriately selected depending on the purpose. Examples thereof include ethyl acetate, acetone, ethyl alcohol, methyl ethyl ketone and toluene. These may be used individually or in combination. Among them, ethyl acetate is particularly preferred from the viewpoints of operability and dissolution capability of resin.

In the primarily drying step, the temperature of the toner composition liquid is preferably the same as the drying temperature, since the vapor pressure can be easily controlled in the primarily drying step and energy loss can be avoided which occurs until the temperature of the toner composition liquid is increased to the drying temperature in the primarily drying step.

The drying temperature in the primarily drying step depends on the type of a solvent used. When ethyl acetate is used, it is preferably 25° C. to 65° C.

Similarly, the drying temperature in the secondarily drying step is preferably 55° C. to 110° C.

<Toner>

A toner of the present invention is produced with the above-described toner production method of the present invention and has a monodisperse particle size distribution. The toner preferably has a particle size distribution (mass average particle diameter/number average particle diameter) of 1.25 or less, more preferably 1.00 to 1.10. The toner having a particle size distribution (mass average particle diameter/number average particle diameter) more than 1.25 has large variations in diameter between particles. Thus, the particles are not uniformly charged, forming abnormal images with background smear, etc. and leading to a drop in image quality in terms of granularity, etc.

The mass average particle diameter of the toner particles is preferably 3 μm to 8 μm, more preferably 4 μm to 6 μm. When the mass average particle diameter is less than 3 μm, highly charged fine powder is generated in a large amount and adhere strongly to carrier to occupy charging sites thereof. As a result, developability degrades; i.e., abnormal images are formed. In addition, such fine powder may give adverse effects to the human body through inhalation. The toner having a mass average particle diameter more than 8 μm goes against a recent trend; i.e., improvement in image quality with small toner particles commonly used, and may not form a high-quality image.

Also, a proportion of particles having a particle diameter of 12.7 μm or greater is preferably 1% or less.

Here, the mass average particle diameter ($D_4$), the number average particle diameter (Dn), and the proportion of particles having a particle diameter of 12.7 μm or greater can be obtained, for example, as follows: a toner sample is subjected to measurement using a particle size analyzer (Multisizer III, product of Beckman Coulter Co.) with the aperture diameter being set to 100 μm, and the obtained measurements are analyzed with analysis software (Beckman Coulter Multisizer 3 Version 3.51.).

The toner can be easily dispersed (i.e., suspended) in an airflow by the action of electrostatic repulsion and thus, can be easily conveyed to a development region with no use of a conveying unit used in conventional electrophotography. Specifically, the toner can be sufficiently conveyed by a weak airflow and thus, can be conveyed to a development region using an air pump having a simple structure for developing. When such toner is used, a latent electrostatic image can be developed in quite good conditions through so-called power cloud development without failure in image formation caused by airflow. Also, the toner of the present invention can be used in conventional developing processes without involving any problems. In this case, a carrier, a developing sleeve, and other members are used simply as a toner bearing unit, and do not need to contribute to a friction charging mechanism together with a toner. Thus, these carrier and members can be formed of a wider variety of materials and can be considerably improved in durability. In addition, inexpensive materials can be used to reduce production cost therefor.

The toner of the present invention is produced from a toner composition liquid prepared by dispersing and/or dissolving, in a solvent, toner materials including at least a resin, a colorant and a releasing agent; and, if necessary, including a charge controlling agent, a magnetic material, a flowability improver, a lubricant, a cleaning aid, a resistivity adjuster and other components.

-Solvent-

The solvent is not particularly limited, so long as it is a (organic) solvent capable of solving the above resin and organic low-molecular-weight compound, and may be appropriately selected depending on the purpose. Examples thereof include water; alcohols such as methanol, ethanol, isopropanol, n-butanol and methyl isocarbinol; ketones such as acetone, 2-butanone, ethyl amyl ketone, diacetone alcohol, isophoron and cyclohexanone; amides such as N,N-dimethylformamide and N,N-dimethylacetamide; ethers such as diethyl ether, isopropyl ether, tetrahydrofuran, 1,4-dioxane and 3,4-dihydro-2H-pyran; glycol ethers such as 2-methoxyethanol, 2-ethoxyethanol, 2-butoxyethanol and ethylene glycol dimethyl ether; glycol ether acetates such as 2-methoxyethyl acetate, 2-ethoxyethyl acetate and 2-butoxyethyl acetate; esters such as methyl acetate, ethyl acetate, butyl acetate, amyl acetate, ethyl lactate and ethylene carbonate; aromatic hydrocarbons such as benzene, toluene and is xylene; aliphatic hydrocarbons such as hexane, heptane, isooctane and cyclohexane; halogenated hydrocarbons such as methylene chloride, 1,2-dichloroethane, dichloropropane and chlorobenzene; sulfoxides such as dimethyl sulfoxide; and pyrrolidones such as N-methyl-2-pyrrolidone and N-octyl-2-pyrrolidone. These may be used individually or in combination.

-Toner Materials-

The toner materials contains at least a resin, a colorant and a releasing agent; and, if necessary, contains a charge controlling agent, a magnetic material, a flowability improver, a lubricant, a cleaning aid, a resistivity adjuster and other components.

-Resin-

The resin is not particularly limited and can be appropriately selected from commonly used resins. Examples thereof include vinyl polymers formed of, for example, styrene monomers, acrylic monomers and/or methacrylic monomers; homopolymers or copolymers of these monomers; polyester resins; polyol resins; phenol resins; silicone resins; polyurethane resins; polyamide resins; furan resins; epoxy resins; xylene resins; terpene resins; coumarone-indene resins; polycarbonate resins; and petroleum resins.

Examples of the styrene monomer include styrene, o-methylstyrene, m-methylstyrene, p-methylstyrene, p-phenylstyrene, p-ethylstyrene, 2,4-dimethylstyrene, p-n-amylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene and p-nitrostyrene.

Examples of the acrylic monomer include acrylic acid, methyl acrylate, ethyl acrylate, propyl acrylate, n-butyl acrylate, isobutyl acrylate, n-octyl acrylate, n-dodecyl acrylate, 2-ethylhexyl acrylate, stearyl acrylate, 2-chloroethyl acrylate and phenyl acrylate.

Examples of the methacrylic monomer include methacrylic acid, methyl methacrylate, ethyl methacrylate, propyl methacrylate, n-butyl methacrylate, isobutyl methacrylate, n-octyl methacrylate, n-dodecyl methacrylate, 2-ethylhexyl methacrylate, stearyl methacrylate, phenyl methacrylate, dimethylaminoethyl methacrylate and diethylaminoethyl methacrylate.

Examples of other monomers forming the vinyl polymers or copolymers include those listed in (1) to (18) given below: (1) monoolefins such as ethylene, propylene, butylene and isobutylene; (2) polyenes such as butadiene and isoprene; (3) halogenated vinyls such as vinyl chloride, vinylidene chloride, vinyl bromide and vinyl fluoride; (4) vinyl esters such as vinyl acetate, vinyl propionate and vinyl benzoate; (5) vinyl ethers such as vinyl is methyl ether, vinyl ethyl ether and vinyl isobutyl ether; (6) vinyl ketones such as vinyl methyl ketone, vinyl hexyl ketone and methyl isopropenyl ketone; (7) N-vinyl compounds such as N-vinylpyrrole, N-vinylcarbazole, N-vinylindole and N-vinylpyrrolidone; (8) vinylnaphthalenes; (9) acrylic or methacrylic acid derivatives such as acrylonitrile, methacrylonitrile and acrylamide; (10) unsaturated dibasic acids such as maleic acid, citraconic acid, itaconic acid, alkenylsuccinic acid, fumaric acid and mesaconic acid; (11) unsaturated dibasic acid anhydride such as maleic anhydride, citraconic anhydride, itaconic anhydride and alkenylsuccinic anhydride; (12) unsaturated dibasic acid monoesters such as monomethyl maleate, monoethyl maleate, monobutyl maleate, monomethyl citraconate, monoethyl citraconate, monobutyl citraconate, monomethyl itaconate, monomethyl alkenylsuccinate, monomethyl fumarate and monomethyl mesaconate; (13) unsaturated dibasic acid esters such as dimethyl maleate and dimethyl fumarate; (14) α,β-unsaturated carboxylic acids such as crotonic acid and cinnamic acid; (15) α,β-unsaturated carboxylic anhydride such as crotonic anhydride and cinnamic anhydride; (16) carboxyl group-containing monomers such as acid anhydrides formed between α,β-unsaturated carboxylic acids and lower fatty acids; and acid anhydrides and monoesters of alkenylmalonic acid, alkenylglutaric acid and alkenyladipic acid; (17) hydroxyalkyl (meth)acrylates such as 2-hydroxyethyl acrylate, 2-hydroxyethyl methacrylate and 2-hydroxypropyl methacrylate; and (18) hydroxy group-containing monomers such as 4-(1-hydroxy-1-methylbutyl)styrene and 4-(1-hydroxy-1-methylhexyl)styrene.

The vinyl polymer or copolymer may have a crosslinked structure formed by a crosslinking agent containing two or more vinyl groups. Examples of the crosslinking agent include aromatic divinyl compounds (e.g., divinyl benzene and divinyl naphthalene); di(meth)acrylate compounds having an alkyl chain as a linking moiety (e.g., ethylene glycol di(meth)acrylate, 1,3-butylene glycoldi(meth)acrylate, 1,4-butanediol di(meth)acrylate, 1,5-pentanediol di(meth)acrylate, 1,6-hexanediol di(meth)acrylate and neopentyl glycol di(meth)acrylate); di(meth)acrylate compounds having, as a linking moiety, an alkyl chain containing an ether bond (e.g., diethylene glycol di(meth)acrylate, triethylene glycol di(meth)acrylate, tetraethylene glycol di(meth)acrylate, polyethylene glycol #400 di(meth)acrylate, polyethylene glycol #600 di(meth)acrylate and dipropylene glycol di(meth)acrylate); di(meth)acrylate compounds having a linking moiety containing an aromatic group or ether bond; and polyester diacrylates (e.g., MANDA (trade name) (product of NIPPON KAYAKU CO., LTD.)).

Examples of multifunctional crosslinking agents which can be used in addition to the above crosslinking agent include pentaerythritol tri(meth)acrylate, trimethylolethane tri(meth)acrylate, trimethylolpropane tri(meth)acrylate, tetramethylolmethane tetra(meth)acrylate, oligoester (meth) acrylate, triallyl cyanurate and triallyl trimellitate.

The amount of the crosslinking agent used is preferably 0.01 parts by mass to 10 parts by mass, more preferably 0.03 parts by mass to 5 parts by mass, per 100 parts by mass of the monomer forming the vinyl polymer or copolymer. Among the above crosslinkable monomers, preferred are aromatic divinyl compounds (in particular, divinyl benzene) and diacrylate compounds having a linking moiety containing one aromatic group or ether bond, since these can impart desired fixing property and offset resistance to the formed toner. Also, copolymers formed between the above monomers are preferably styrene copolymers and styrene-acrylic copolymers.

Examples of polymerization initiators used for producing the vinyl polymer or copolymer include 2,2'-azobisisobutylonitrile, 2,2'-azobis (4-methoxy-2,4-dimethylvaleronitrile), 2,2'-azobis (2,4-dimethylvaleronitrile), 2,2'-azobis (2-methylbutylonitrile),dimethyl-2,2'-azobisisobutyrate, 1,1'-azobis (1-cyclohexanecarbonitrile), 2-(carbamoylazo)-isobutylonitrile, 2,2'-azobis (2,4,4-trimethylpentane), 2-phenylazo-2',4'-dimethyl-4'-methoxyvaleronitrile, 2,2'-azobis (2-methylpropane), ketone peroxides (e.g., methyl ethyl ketone peroxide, acetylacetone peroxide and cyclohexanone peroxide), 2,2-bis (tert-butylperoxy)butane, tert-butyl hydroperoxide, cumene hydroperoxide, 1,1,3,3-tetramethylbutyl hydroperoxide, di-tert-butylperoxide, tert-butyl cumylperoxide, dicumyl peroxide, α-(tert-butylperoxy)isopropylbenzene, isobutyl peroxide, octanoyl peroxide, decanoyl peroxide, lauroyl peroxide, 3,5,5-trimethylhexanoyl peroxide, benzoyl peroxide, m-tolyl peroxide, di-isopropyl peroxydicarbonate, di-2-ethylhexyl peroxydicarbonate, di-n-propyl peroxydicarbonate, di-2-ethoxyethyl peroxycarbonate, di-ethoxyisopropyl peroxydicarbonate, di(3-methyl-3-methoxybutyl)peroxycarbonate, acetylcyclohexylsulfonyl peroxide, tert-butyl peroxyacetate, tert-butylperoxyisobutylate, tert-butylperoxy-2-ethylhexalate, tert-butylperoxylaurate, tert-butyl-oxybenzoate, tert-butylperoxyisopropylcarbonate, di-tert-butylperoxyisophthalate, tert-butylperoxyallylcarbonate, isoamylperoxy-2-ethylhexanoate, di-tert-butylperoxyhexahydroterephthalate and tert-butylperoxyazelate.

When the binder resin is a styrene-acrylic resin, tetrahydrofuran (THF) soluble matter of the resin preferably has such a molecular weight distribution as measured by GPC that at least one peak exists in a range of M.W. 3,000 to M.W. 50,000 (as reduced to a number average molecular weight) and at least one peak exists in a range of M.W. 100,000 or higher, since the formed toner has desired fixing property, offset resistance and storage stability. Preferably, THF soluble matter of the binder resin has a component with a molecular weight equal to or lower than M.W. 100,000 of 50% to 90%, more preferably has a main peak in a range of M.W. 5,000 to M.W. 30,000, most preferably M.W. 5,000 to M.W. 20,000.

When the binder resin is a vinyl polymer such as a styrene-acrylic resin, the acid value thereof is preferably 0.1 mgKOH/g to 100 mgKOH/g, more preferably 0.1 mgKOH/g to 70 mgKOH/g, still more preferably 0.1 mgKOH/g to 50 mgKOH/g.

Examples of the monomer forming the polyester resin include dihydric alcohols such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A; and diol products formed between bisphenol A and a cyclic ether (e.g., ethylene oxide and propylene oxide).

Alcohols having three or more hydroxyl groups are preferably used for crosslinking reaction of the polyester resin.

Examples of the alcohols having three or more hydroxyl groups include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl- 1,2,4-butanetriol, trimethylolethane, trimethylolpropane and 1,3,5-trihydroxybenzene.

Examples of the acid forming the polyester resin include benzenedicarboxylic acids (e.g., phthalic acid, isophthalic acid and terephthalic acid) and anhydrides thereof; alkyldicarboxylic acids (e.g., succinic acid, adipic acid, sebacic acid and azelaic acid) and anhydrides thereof; unsaturated dibasic acids (e.g., maleic acid, citraconic acid, itaconic acid, alkenylsuccinic acid, fumaric acid and mesaconic acid; unsaturated dibasic acid anhydrides (e.g., maleic anhydride, citraconic anhydride, itaconic anhydride and alkenylsuccinic anhydride); carboxylic acids having three or more carboxyl groups (e.g., trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-haxanetricarboxylic acid, 1,3-dicarboxyl-2-methyl-2-methylenecarboxypropane, tetra(methylenecarboxylic) methane, 1,2,7,8-octanetetracarboxylic acid and Enpol trimer acid); anhydrides of these carboxylic acids having three or more carboxyl groups; and partial alkyl esters of these carboxylic acids having three or more carboxyl groups.

When the binder resin is a polyester resin, THF soluble matter of the resin preferably has such a molecular weight distribution that at least one peak exists in a range of M.W. 3,000 to M.W. 50,000, since the formed toner has desired fixing property and offset resistance. Preferably, THF soluble matter of the binder resin has a component with a molecular weight equal to or lower than M.W. 100,000 of 60% to 100%, more preferably has at least one peak in a range of M.W. 5,000 to M.W. 20,000.

Also, the acid value of the polyester resin is preferably 0.1 mgKOH/g to 100 mgKOH/g, more preferably 0.1 mgKOH/g to 70 mgKOH/g, still more preferably 0.1 mgKOH/g to 50 mgKOH/g.

The molecular weight distribution of the binder resin is determined through gel permeation chromatography (GPC) using THF as a solvent.

Also, into at least one of the vinyl polymer and the polyester resin, resins having a monomer component capable of reacting therewith may be incorporated. Examples of monomers which form polyester resins and are capable of reacting with a vinyl polymer include unsaturated dicarboxylic acids (e.g., phthalic acid, maleic acid, citraconic acid and itaconic acid) and anhydrides thereof. Examples of monomers forming the vinyl polymer include those having a carboxyl group or hydroxyl group; and (meth)acrylates.

When the polyester resin, the vinyl polymer and other binder resins are used in combination, 60% by mass or higher of the mixed binder resin preferably have an acid value of 0.1 mgKOH/g to 50 mgKOH/g.

The acid value of the binder resin is measured according to JIS K-0070 as follows:

(1) additives other than a binder resin (polymer component) are removed to prepare a sample, followed by pulverizing, and 0.5 g to 2.0 g of the thus-obtained sample is precisely weighed (W g); (note that when the acid value of the binder resin is measured using an untreated toner sample, a colorant, a magnetic material, etc. other than the binder resin and crosslinked binder resin are separately measured in advance for their content and acid value; and the acid value of the binder resin is calculated based on the thus-obtained value);

(2) the sample is placed in a 300-mL beaker and dissolved using a liquid mixture of toluene/ethanol (4/1 by volume) (150 mL);

(3) the resultant sample solution and a blank sample are titrated with a 0.1 mol/L solution of KOH in ethanol using a potentiometric titrator; and (4) using the amount (S mL) of the KOH solution consumed for the sample solution and the amount (B mL) of the KOH solution consumed for the blank sample, the acid value of the sample is calculated based on Equation (1):

$$\text{Acid value (mgKOH/g)}=[(S-B)\times f\times 5.61]/W \qquad \text{Equation (1)}$$

where f is a factor of KOH.

The binder resin preferably have a glass transition temperature (Tg) of 35° C. to 80° C., more preferably 40° C. to 75° C., from the viewpoint of attaining desired storage stability of the formed toner. When the glass transition temperature (Tg) is lower than 35° C., the formed toner tends to degrade under high temperature conditions and to involve offset during fixing. When the Tg is higher than 80° C., the formed toner may have degraded fixing property.

-Colorant-

The colorant is not particularly limited and can be appropriately selected depending on the purpose. Examples thereof include carbon black, nigrosine dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red F5R, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS and BC), indigo, ultramarine, iron blue, anthraquinon blue, fast violet B, methylviolet lake, cobalt purple, manganese violet, dioxane violet, anthraquinon violet, chrome green, zinc green, chromium oxide, viridian, emerald green, pigment green B, naphthol green B, green gold, acid green lake, malachite green lake, phthalocyanine green, anthraquinon green, titanium oxide, zinc flower, lithopone, and mixtures thereof.

The colorant content of the toner is preferably 1% by mass to 15% by mass, preferably 3% by mass to 10% by mass.

In the present invention, the colorant may be mixed with a resin to form a masterbatch. Examples of the binder resin which is to be kneaded together with a masterbatch include modified or unmodified polyester resins; styrene polymers and substituted products thereof (e.g., polystyrenes, poly-p-chlorostyrenes and polyvinyltoluenes); styrene copolymers (e.g., styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene -methyl methacrylate copolymers, styrene -ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene -acrylonitrile-indene copolymers, styrene-maleic acid copolymers, styrene-maleic acid ester copolymers); polymethyl methacrylates; polybutyl methacrylates; polyvinyl chlorides; polyvinyl acetates; polyethylenes; polypropylenes, polyesters; epoxy resins; epoxy polyol resins; polyurethanes; polyamides; polyvinyl butyrals; polyacrylic acid resins; rosin; modified rosin; terpene resins; aliphatic or alicyclic hydrocarbon resins; aromatic petroleum resins; chlorinated paraffins; and paraffin waxes. These may be used alone or in combination.

The masterbatch can be prepared by mixing/kneading a colorant with a resin for use in a masterbatch through application of high shearing force. Also, an organic solvent may be used for improving mixing between these materials. Further, the flashing method, in which an aqueous paste containing a colorant is mixed/kneaded with a resin and an organic solvent and then the colorant is transferred to the resin to remove water and the organic solvent, is preferably used, since a wet cake of the colorant can be directly used (i.e., no drying is required to be performed). In this mixing/kneading, a high-shearing disperser (e.g., three-roll mill) is preferably used.

The amount of the masterbatch used is preferably 0.1 parts by mass to 20 parts by mass per 100 parts by mass of the binder resin.

The resin used for forming the masterbatch preferably has an acid value of 30 mgKOH/g or lower and amine value of 1 to 100, more preferably has an acid value of 20 mgKOH/g or lower and amine value of 10 to 50. In use, a colorant is preferably dispersed in the resin. When the acid value is higher than 30 mgKOH/g, chargeability degrades at high humidity and the pigment is insufficiently dispersed. Meanwhile, when the amine value is lower than 1 or higher than 100, the pigment may also be insufficiently dispersed. Notably, the acid value can be measured according to JIS K0070, and the amine value can be measured according to JIS K7237.

Also, a dispersant used preferably has higher compatibility with the binder resin from the viewpoint of attaining desired dispersibility of the pigment. Specific examples of commercially available products thereof include "AJISPER PB821," AJISPER PB822" (these products are of Ajinomoto Fin-Techno Co., Inc.), "Disperbyk-2001" (product of BYK-chemie Co.) and "FFKA-4010" (product of EFKA Co.).

The dispersant is preferably incorporated into the toner in an amount of 0.1% by mass to 10% by mass with respect to the colorant. When the amount is less than 0.1% by mass, the pigment is insufficiently dispersed. Whereas when the amount is more than 10% by mass, chargeability degrades at high humidity.

The dispersant preferably has a mass average molecular weight as measured through gel permeation chromatography of 500 to 100,000, more preferably 3,000 to 100,000, particularly preferably 5,000 to 50,000, most preferably 5,000 to 30,000, from the viewpoint of attaining desired dispersibility of the pigment, wherein the mass average molecular weight is a maximum molecular weight as converted to styrene on a main peak. When the mass average molecular weight is lower than 500, the dispersant has high polarity, potentially degrading dispersibility of the colorant. Whereas when the mass average molecular weight is higher than 100,000, the dispersant has high affinity to a solvent, potentially degrading dispersibility of the colorant.

The amount of the dispersant used is preferably 1 part by mass to 50 parts by mass, more preferably 5 parts by mass to 30 parts by mass, per 100 parts by mass of the colorant. When the amount is less than 1 part by mass, dispersibility may degrade; whereas when the amount is more than 50 parts by mass, chargeability may degrade.

-Releasing Agent-

The releasing agent is used for improving low-temperature fixing property and offset resistance upon fixing, and is particularly preferably an acid-modified hydrocarbon wax. Use of the acid-modified hydrocarbon wax allows the formed toner to be improved in offset resistance and low-temperature fixing property. In addition, the particle diameter of the releasing agent dispersed can be made to be small to prevent crystal growth thereof, resulting in preventing nozzle clogging.

Examples of the hydrocarbon wax include paraffin waxes, sasol waxes and polyolefin waxes (e.g., polyethylene waxes and polypropylene waxes). These may be used alone or in combination. Among them, paraffin waxes, having a low melting point, are particularly preferred, since the formed toner has desired low-temperature fixing property and desired offset resistance.

The method for modifying hydrocarbon waxes is not particularly limited. For example, there can be used the method disclosed in, for example, JP-A Nos. 54-30287, 54-81306, 58-43967, 60-16442, 03-199267 and 2000-10338. Examples of acids used for modifying hydrocarbon waxes include unsaturated polycarboxylic acids and anhydrides thereof (e.g., maleic acid, maleic anhydride, itaconic acid, itaconic anhydride, citraconic acid and citraconic anhydride). Of these, maleic anhydride is preferred, since it has high reactivity and improves dispersibility of the releasing agent.

As mentioned above, when a paraffin wax having a low melting point is used as a hydrocarbon wax, the formed toner can have desired low-temperature fixing property and desired offset resistance. Further, when modified with maleic anhydride, the hydrocarbon wax is finely dispersed to prepare a stable dispersion. In the toner production, when periodically discharged with a mechanical vibrating unit for forming liquid droplets, the thus-prepared toner composition liquid does not cause nozzle clogging. In addition, the thus-modified wax is stably and finely dispersed, resulting in the formed toner can exhibit more excellent low-temperature fixing property and offset resistance.

The releasing agent preferably has an acid value of 1 KOHmg/g to 90 KOHmg/g. More preferably, it has an acid value of 5 KOHmg/g to 50 KOHmg/g, from the viewpoints of attaining sufficient dispersibility of the releasing agent and desired offset resistance of the formed toner. When the acid value is lower than 5 mgKOH/g, dispersibility of the releasing agent is not sufficient, causing nozzle clogging. Even if toner particles are formed, their properties may degrade such as flowability, chargeability and fixing property. Whereas when the acid value is higher than 90 mgKOH/g, wax particles are removed when jetted from nozzles for liquid droplet formation, potentially causing offset resistance of the formed toner. In addition, such a releasing agent is not desirably separated from the binder resin, potentially forming a toner having an insufficient offset resistance.

Notably, the acid value is measured using the potentiometric automatic titrator DL-53 (product of Mettler-Toledo K.K.), the electrode DG113-SC (product of Mettler-Toledo K.K.) and the analysis software LabX Light Version 1.00.000. The calibration for this measurement is performed using a solvent mixture of toluene (120 mL) and ethanol (30 mL). The measurement temperature is 23° C., and the measurement conditions are as follows.

Speed[%] 25
Time[s] 15
EQP Titration
Titrant/Sensor
Titrant $CH_3ONa$
Concentration[mol/L] 0.1
Sensor DG115
Unit of measurement mV
Predispensing to Volume
Volume[mL] 1.0
Wait time[s] 0
Titrant Addition Dynamic
dE(set)[mV] 8.0
dV(min)[mL] 0.03
dV(max)[mL] 0.5
Measure Mode Equilibrium Controlled
dE[mV] 0.5
dt[s] 1.0
t(min)[s] 2.0
t(max)[s] 20.0
Recognition
Threshold 100.0
Steepest Jump Only No
Range No
Tendency None
Termination
At maximum volume[mL] 10.0
At potential No
At slope No
After number EQPs Yes
n=1
comb. Termination conditions No
Evaluation
Procedure Standard
Potential 1 No
Potential 2 No
Stop for reevaluation No Specifically, the acid value is measured according to JIS K0070-1992 as follows. Firstly, a sample (0.5 g) is added to toluene (120 mL), followed by dissolving under stirring at room temperature (23° C.) for about 10 hours and then ethanol (30 mL) is added to the resultant solution. The thus-prepared sample solution is titrated with a pre-standardized 0.1N potassium hydroxide alcohol solution. The acid value is calculated from the thus-obtained titration value X (mL) using the following equation:

$$\text{Acid value}=X\times N\times 56.1/\text{mass of sample (KOHmg/g)}$$

where N is a factor of 0.1N alcohol solution of KOH.

The releasing agent preferably has a melt viscosity as measured at 120° C. of 1.0 mPa·s to 30 mPa·s, more preferably 1.0 mPa·s to 10 mPa·s, from the viewpoints of improving fixing property and offset resistance of the formed toner. When the melt viscosity is lower than 1.0 mPa·s, the formed toner may exhibit degraded flowability; whereas when the melt viscosity is higher than 30 mPa·s, the formed toner may exhibit degraded offset resistance.

Note that the melt viscosity is measured using a Brookfield rotary viscometer.

The releasing agent preferably has a melting point of 55° C. to 90° C. Here, the melting point is a temperature at which the maximum amount of heat absorbed by the releasing agent is observed on a DSC curve obtained through differential scanning calorimetry (DSC). As a DSC measurement device, there is preferably used a highly precise differential scanning calorimeter of inner-heat input compensation type. This measurement test is performed according to ASTM D3418-82.

The DSC curve is obtained as follows: the temperature of a releasing agent is once raised and then decreased to previously maintain pre-history records therefor; and the temperature of the releasing agent is raised at a temperature increasing rate of 10° C./min. When the melting point of the releasing agent is lower than 50° C., blocking easily occurs during production and storage of the formed toner, potentially degrading heat resistance/storage stability thereof. Whereas when the melting point of the releasing agent is higher than 90° C., the formed toner may exhibit degraded low-temperature fixing property and degraded offset resistance.

The amount of the releasing agent contained in the toner is preferably 0.1 parts by mass to 20 parts by mass, more preferably 0.5 parts by mass to 10 parts by mass, per 100 parts by mass of the resin. When the amount is less than 0.1 parts by mass, the releasing agent do not sufficiently exhibit its effect, potentially causing degradation of offset resistance of the formed toner. Whereas when the amount is more than 20 parts by mass, the formed toner may exhibit degraded flowability and/or may adhere to a developing device.

-Magnetic Material-

Examples of the magnetic material include (1) magnetic iron oxides (e.g., magnetite, maghemite and ferrite), and iron oxides containing other metal oxides; (2) metals such as iron, cobalt and nickel, and alloys prepared between these metals and metals such as aluminum, cobalt, copper, lead, magnesium, tin, zinc, antimony, beryllium, bismuth, cadmium, calcium, manganese, selenium, titanium, tungsten and/or vanadium; and (3) mixtures thereof.

Specific examples of the magnetic material include $Fe_3O_4$, $\gamma$-$Fe_2O_3$, $ZnFe_2O_4$, $Y_3Fe_5O_{12}$, $CdFe_2O_4$, $Gd_3Fe_5O_{12}$, $CuFe_2O_4$, $PbFe_{12}O$, $NiFe_2O_4$, $NdFe_2O$, $BaFe_{12}O_{19}$, $MgFe_2O_4$, $MnFe_2O_4$, $LaFeO_3$, iron powder, cobalt powder, and nickel powder. These may be used alone or in combination. Of these, micropowders of ferrosoferric oxide or γ-iron sesquioxide are particularly preferred.

Further, magnetic iron oxides (e.g., magnetite, maghemite and ferrite) containing other elements or mixtures thereof can be used. Examples of the other elements include lithium, beryllium, boron, magnesium, aluminum, silicon, phosphorus, germanium, zirconium, tin, sulfur, calcium, scandium, titanium, vanadium, chromium, manganese, cobalt, nickel, copper, zinc and gallium. Of these, magnesium, aluminum, silicon, phosphorus and zirconium are particularly preferred. The other element may be incorporated in the crystal lattice of an iron oxide, may be incorporated into an iron oxide in the form of oxide, or may be present on the surface of an iron oxide in the form of oxide or hydroxide. Preferably, it is contained in the form of oxide.

Incorporation of the other elements into the target particles can be performed as follows: salts of the other elements are allowed to coexist with the iron oxide during formation of a magnetic material, and then the pH of the reaction system is appropriately adjusted. Alternatively, after formation of magnetic particles, the pH of the reaction system may be adjusted with or without salts of the other elements, to thereby precipitate these elements on the surface of the particles.

The amount of the magnetic material used is preferably 10 parts by mass to 200 parts by mass, more preferably 20 parts by mass to 150 parts by mass based on 100 parts by mass of the binder resins. The number average particle diameter of the magnetic material is preferably 0.1 μm to 2 μm, more preferably 0.1 μm to 0.5 μm. The number average particle diameter of the magnetic material can be measured by observing a magnified photograph thereof obtained through transmission electron microscopy using a digitizer or the like.

For magnetic properties of the magnetic material under application of 10 kOersted, it is preferably to use a magnetic material having an anti-magnetic force of 20 Oersted to 150 Oersted, a saturation magnetization of 50 emu/g to 200 emu/g, and a residual magnetization of 2 emu/g to 20 emu/g.

The magnetic material can also be used as a colorant.

-Charge Controlling Agent-

The charge controlling agent is not particularly limited and may be appropriately selected from those known in the art depending on the purpose. Examples thereof include Nigrosine dyes, triphenylmethane dyes, chrome-containing metal complex dyes, molybdic acid chelate pigments, Rhodamine dyes, alkoxy-based amines, quaternary ammonium salts (including fluorine-modified quaternary ammonium salts), alkylamide, single substance or compounds of phosphorus, single substance or compounds of tungsten, fluorine-based active agents, metal salicylates, and metal salts of salicylic acid derivatives. These may be used individually or in combination.

The charge controlling agent may be commercially available products. Examples thereof include BONTRON 03 (Nigrosine dye), BONTRON P-51 (quaternary ammonium salt), BONTRON S-34 (metal-containing azo dye), BONTRON E-82 (oxynaphthoic acid metal complex), E-84 (salicylic acid metal complex), and E-89 (phenolic condensation product), which are manufactured by Orient Chemical Industries, Ltd.; TP-302 and TP-415 (quaternary ammonium salt molybdenum complex), which are manufactured by Hodogaya Chemical Co., LTD.; COPY CHARGE PSY VP2038 (quaternary ammonium salt), COPY BLUE PR (triphenylmethane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments; and polymeric compounds having a functional group such as a sulfonate group, a carboxyl group, or a quaternary ammonium salt group.

The amount of the charge controlling agent used is determined depending on the type of binder resins used, presence or absence of additives used in accordance with necessity, and the toner production method including dispersing process and thus is unequivocally defined, however, it is preferably 0.1 parts by mass to 10 parts by mass, more preferably 0.2 parts by mass to 5 parts by mass, per 100 parts by mass of the binder resin. When the amount of the charge controlling agent is more than 10 parts by mass, the effect of a main charge controlling agent is reduced due to the excessive electrostatic property of the toner, and the electrostatic attraction force to the developing roller used may be increased to cause a degradation in flowability of the developer and a degradation in image density. These charge controlling agents and releasing agents may be melt-kneaded together with the masterbatch and resins or may be added when the binder resins, the colorant and the like are dissolved and dispersed in an organic solvent.

-Flowability Improver-

A flowability improver may be added in the toner of the present invention. The flowability improver is incorporated onto the surface of the toner to improve the flowability thereof.

Examples of the flowability improver include fluorine-based resin powders such as fluorinated vinylidene fine powder and polytetrafluoroethylene fine powder; silica fine powders such as wet-process silica and dry-process silica; titanium oxide fine powder, alumina fine powder, and surface-treated silica powders, surface-treated titanium oxide and surface-treated alumina each of which is prepared by subjecting titanium oxide fine powder or alumina fine powder to a surface treatment with a silane coupling agent, titanium coupling agent or silicone oil. Of these, silica fine powder, titanium oxide fine powder, and alumina fine powder are preferable. Further, surface-treated silica powders each of which is prepared by subjecting alumina fine powder to a surface treatment with a silane coupling agent or silicone oil are still more preferably used.

The particle size of the flowability improver is, as an average primary particle diameter, preferably 0.001 μm to 2 μm, more preferably 0.002 μm to 0.2 μm.

The silica fine powder is produced by vapor-phase oxidation of a silicon halide compound, is so-called "dry-process silica" or "fumed silica".

As commercially available products of the silica fine powders produced by vapor-phase oxidation of a silicon halide compound, for example, AEROSIL (trade name, manufactured by Japan AEROSIL Inc.) -130, -300, -380, -TT600, -MOX170, -MOX80 and -COK84; CA-O-SIL (trade name, manufactured by CABOT Corp.) -M-5, -MS-7, -MS-75, -HS-5, -EH-5; Wacker HDK (trade name, manufactured by WACKER-CHEMIE GMBH) -N20 -V15, -N20E, -T30, and -T40; D-C FINE SILICA (trade name, manufactured by Dow Corning Co., Ltd.); and FRANSOL (trade name, manufactured by Fransil Co.).

Further, a hydrophobized silica fine powder prepared by hydrophobizing a silica fine powder produced by vapor-phase oxidation of a silicon halide compound is more preferable. It is particularly preferable to use a silica fine powder that is hydrophobized so that a hydrophobization degree measured by a methanol titration test is preferably from 30% to 80%. A silica fine powder can be hydrophobilized by being chemically or physically treated with an organic silicon compound reactive to or physically absorbed to the silica fine powder, or the like. There is a preferred method, in which a silica fine powder produced by vapor-phase oxidation of a silicon halide compound is hydrophobilized with an organic silicon compound.

Examples the organic silicon compound include hydroxypropyltrimethoxysilane, phenyltrimethoxysilane, n-hexadecyltrimethoxysilane, n-octadecyltrimethoxysilane, vinylmethoxysilane, vinyltriethoxysilane, vinyltriacetoxysilane, dimethylvinylchlorosilane, divinylchlorosilane, γ-methacryloxypropyltrimethoxysilane, hexamethyldisilane, trimethylsilane, trimethylchlorosilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptane, trimethylsilylmercaptane, triorganosilylacrylate, vinyldimethylacetoxysilane, dimethylethoxysilane, trimethylethoxysilane, trimethylmethoxysilane, methyltriethoxysilane, isobutyltrimethoxysilane, dimethyldimethoxysilane, diphenyldiethoxysilane, hexamethyldisiloxane, 1,3-divinytetramethyldisiloxane, 1,3-diphenyltetramethyldisiloxane, and dimethylpolysiloxane having 2 to 12 siloxane units per molecule and having 0 to 1 hydroxy group bonded to Si in the siloxane units positioned at the terminals. Further, silicone oils such as dimethylsilicone oil are exemplified. These organic silicon compounds may be used alone or in combination.

The number average particle diameter of the flowability improver is preferably 5 nm to 100 nm, and more preferably 5 nm to 50 nm.

The specific surface area of fine powder of the flowability improver measured by the BET nitrogen absorption method is preferably 30 $m^2/g$ or more, and more preferably 60 $m^2/g$ to 400 $m^2/g$.

In the case of surface treated fine powder of the flowability improver, the specific surface area is preferably 20 $m^2/g$ or more, and more preferably 40 $m^2/g$ to 300 $m^2/g$.

The use amount of the fine powder is preferably 0.03 parts by mass to 8 parts by mass based on 100 parts by mass of toner particles.

-Cleanability Improver-

As the cleanability improver for improving removability of residual toner remaining on a latent electrostatic image bearing member and a primary transfer member after transferring the toner onto a recording paper sheet or the like, for example, fatty acid metal salts such as zinc stearate, calcium stearate, and stearic acid; and polymer fine particles produced by soap-free emulsion polymerization, such as polymethylmethacrylate fine particles and polystyrene fine particles are exemplified. The polymer fine particles preferably have a relatively narrow particle size distribution and a volume average particle diameter of 0.01 μm to 1 μm.

These flowability improvers, cleanability improvers and the like are used in a state of adhering on or being fixed on the surface of the toner and thus is called "additives". Usually, these improvers are externally added to toner using any of powder mixers such as V-type mixer, rocking mixer, LOEDIGE mixer, NAUTA mixer, HENSCHEL mixer. When these improvers are solidified, Hybridizer, Mechanofusion, Q mixer, etc. are used.

<Developer>

A toner of the present invention is used as a developer. The developer may contain appropriately selected other components such as a carrier. The developer may be a one-component developer or a two-component developer. For use in a high-speed printer responding to increasing of the recent information processing speed, the two-component developer is preferred from the viewpoint of attaining long service life.

The one-component developer containing the toner exhibits less variation in toner particle diameter even after repetitive cycles of consumption and addition thereof. And, it does not cause filming on a developing roller or fuse/adhere on a layer thickness controlling member such as a blade for making a toner layer thin. In addition, the developer attains stable, excellent developability and image formation even after long-term use (stirring) in a developing device. Also, the two-component developer containing the toner exhibits less variation in toner particle diameter even after repetitive cycles of consumption and addition thereof. The developer attains stable, excellent developability even after long-term stirring in a developing device.

As to the carrier, typically used carrier such as ferrite and magnetite and resin-coated carrier can be used.

The resin-coated carrier is composed of a coating agent containing carrier core particles and a resin covering surfaces of the carrier core particles.

The resin used as the coating agent is not particularly limited and may be appropriately selected depending on the purpose. Examples thereof include styrene-acrylic ester copolymers, styrene-methacrylic ester copolymers, mixtures of fluorine-containing resins and styrene-based copolymers, silicone resins, polyester resins, polyamide resins and ionomer resins. Of these, silicone resins are particularly preferred.

Examples of the mixtures fluorine-containing resins and styrene-based copolymers include a mixture between polyvinylidene fluoride and a styrene-methyl methacrylate copolymer, a mixture between polytetrafluoroethylene and a styrene-methyl methacrylate copolymer, a mixture of vinylidene fluoride-tetrafluoroethylene copolymer (copolymerization mass ratio=10:90 to 90:10), a mixture of styrene-2-ethylhexyl acrylate copolymer (copolymerization mass ratio=10:90 to 90:10); a mixture of styrene-2-ethylhexyl acrylate-methyl methacrylate copolymer (copolymerization mass ratio=20 to 60:5 to 30:10 to 50).

For the silicone resin, modified silicone resins produced by reaction of a nitrogen-containing silicone resin and a nitrogen-containing silane coupling agent with a silicone resin are exemplified.

In addition, it is possible to use a binder type carrier core in which magnetic powder is dispersed in a resin.

As a method of covering the surface of a carrier core with at least a resin-coating agent in the resin-coated carrier, the following methods can be used: a method in which a resin is dissolved or suspended to prepare a coating solution, and the coating solution is applied over a surface of the carrier core so as to be adhered thereon; or a method of mixing a resin in a state of powder, simply.

The mixing ratio of the coating agent to the resin-coated carrier is not particularly limited and may be suitably selected in accordance with the intended use. For example, it is preferably 0.01% by mass to 5% by mass, and more preferably 0.1% by mass to 1% by mass with respect to the resin coated carrier.

For usage examples of coating a magnetic material with two or more types of coating agent, the following are exemplified: (1) coating a magnetic material with 12 parts by mass of a mixture prepared using dimethyldichlorosilane and dimethyl silicon oil based on 100 parts by mass of titanium oxide fine powder at a mass ratio of 1:5; and (2) coating a magnetic material with 20 parts by mass of a mixture prepared using dimethyldichlorosilane and dimethyl silicon oil based on 100 parts by mass of silica fine powder at a mass ratio of 1:5.

As the magnetic material for carrier core, it is possible to use ferrite, iron-excessively contained ferrite, magnetite, oxide such as γ-iron oxide; or metal such as iron, cobalt, and nickel or an alloy thereof.

Further, examples of elements contained in these magnetic materials include iron, cobalt, nickel, aluminum, copper, lead, magnesium, tin, zinc, antimony, beryllium, bismuth, calcium, manganese, selenium, titanium, tungsten, and vanadium. Of these elements, copper-zinc-iron-based ferrite containing copper, zinc and iron as main components, and manganese-magnesium-iron-based ferrite containing manganese, magnesium, and iron components as main components are particularly preferable.

For the resistance value of the carrier, it is preferable to adjust the degree of convexo-concave of the carrier surface and the amount of resin used for coating a carrier core so as to be $10^6$ Ω·cm to $10^{10}$ Ω·cm.

The particle diameter of the carrier is preferably 4 μm to 200 μm, more preferably 10 μm to 150 μm, and still more preferably 20 μm to 100 μm.

In a two-component developer, the toner of the present invention is preferably used in an amount of 1 part by mass to 200 parts by mass, more preferably 2 parts by mass to 50 parts by mass, per 100 parts by mass of the carrier.

In image developing processes using the toner of the present invention, all of the conventional latent electrostatic image bearing members used in electrophotography can be used. For example, organic latent electrostatic image bearing members, amorphous-silica latent electrostatic image bearing members, selenium latent electrostatic image bearing members and zinc-oxide latent electrostatic image bearing members are suitably used.

EXAMPLES

The present invention will next be described in detail by way of Examples, which should not be construed as limiting the present invention thereto.

Example 1

-Preparation of Colorant Dispersion-

First, a dispersion of carbon black (colorant) was prepared.

Specifically, carbon black (Regal 400, product of Cabot Corporation) (20 parts by mass) and a pigment dispersant (AJISPER PB821, product of Ajinomoto Fin-Techno Co., Inc.) (2 parts by mass) were primarily dispersed in ethyl acetate (78 parts by mass) using a mixer having an impeller.

The resultant primary dispersion was more finely dispersed through application of strong shearing force using the DYNO-MILL (product of Shinmaru Enterprises Corporation) to prepare a secondary dispersion containing no aggregates. The resultant secondary dispersion was caused to pass through a PTFE filter having a pore size of 0.45 μm to prepare a dispersion containing submicron particles.

-Preparation of Dispersion Containing Resin and Wax-

A container equipped with an impeller and a thermometer was charged with a polyester resin (binder resin) (mass average molecular weight: 20,000) (186 parts by mass), maleic anhydride-modified paraffin wax (acid value: 20 mgKOH/g) (10 parts by mass) and ethyl acetate (2,000 parts by mass). The resultant mixture was heated to 85° C. and stirred for 20 min, to thereby dissolve the polyester resin and the modified paraffin wax. The solution was quenched to precipitate microparticles of the modified paraffin wax. The resultant dispersion was more finely dispersed through application of strong shearing force using the DYNO-MILL. Through the above procedure, a dispersion containing resin and wax was prepared.

-Preparation of Toner Composition Liquid-

The above-prepared carbon black dispersion (30 parts by mass) and the above-prepared resin/wax-containing dispersion (1,100 parts by mass) were mixed with each other using a mixer having an impeller. The obtained toner composition liquid was diluted with ethyl acetate so that the solid content thereof was adjusted to 6.0% by mass, to thereby prepare a toner composition liquid.

The resultant toner composition liquid was found to have a viscosity of 1.4 mPa·s (25° C.) and a surface tension of 24.3 dyn/cm.

-Production of Toner-

The above-prepared toner composition liquid was fed to the head of a ring-shaped vibrator in a toner production apparatus illustrated in FIG. 11.

The thin film used was a nickel film (outer diameter: 8.0 mm, thickness: 20 μm) having truly spherical ejection holes (nozzles) (diameter: 8 μm), which was produced through electroforming. The ejection holes were arranged in a lattice form only within a circle having the center of the film and a diameter of about 5 mm so that the interdistance therebetween was adjusted to 100 μm. The piezoelectric element used was a laminated lead zirconium titanate (PZT), which was used at a vibration frequency of 100 KHz.

After had been discharged from the nozzles of the thin film, liquid droplets were solidified thorough drying under the following conditions to produce toner particles. The dried/solidified toner particles were recovered through cyclone. The liquid droplet discharging velocity was 8 m/sec. Nitrogen gas containing a predetermined amount of ethyl acetate (organic solvent) (saturated vapor pressure: 760 mmHg, boiling point: 77° C.) sprayed with a sprayer was used as a gas for the primarily drying step to generate an ethyl acetate partial pressure. The temperature of the toner composition liquid was found to be 35° C. in the primarily drying step. Notably, toner production was performed for 5 consecutive hours without nozzle clogging.

The velocity of dry gas was measured with a hot-wire anemometer (product of SHIBATA SCIENTIFIC TECHNOLOGY LTD.).

[Drying Conditions]

Flow rate of dry air: nitrogen gas for the primary step: 200 L/min (velocity: 43 m/sec); partial pressure of ethyl acetate: ⅕ (with respect to saturated vapor pressure of ethyl acetate); temperature: 35° C.

Flow rate of dry air: nitrogen gas for the secondary step: 500 L/min; partial pressure of ethyl acetate: 0; temperature: 80° C.

Then, hydrophobic silica (H2000, product of Clariant Japan K.K.) (1.0% by mass) was externally added to the obtained toner particles, and the mixture was treated with a Henschel mixer (product of Mitsui Mining Co., Ltd.) to produce black toner a.

-Production of Carrier-

Silicone resin (organo straight silicone): 100 parts by mass

Toluene: 100 parts by mass

γ-(2-Aminoethyl)aminopropyltrimethoxysilane: 5 parts by mass

Carbon black: 10 parts by mass

The above-listed components were mixed with one another, and the resultant mixture was dispersed using a homomixer for 20 min to prepare a coat layer-forming liquid. The thus-prepared liquid was applied onto spherical magnetite (particle diameter: 50 μm) (1,000 parts by mass) using a fluidized bed coater, to thereby produce a magnetic carrier.

-Preparation of Developer-

Toner a (4 parts by mass) and the thus-produced magnetic carrier (96 parts by mass) were mixed with each other using a ball mill to prepare two-component developer 1.

Example 2

The procedure of Example 1 was repeated, except that the drying conditions were changed as follows, to thereby produce toner b and a developer.

[Drying Conditions]

Flow rate of dry air: nitrogen gas for the primary step: 410 L/min (velocity: 87 m/sec); partial pressure of ethyl acetate: ⅓ (with respect to saturated vapor pressure of ethyl acetate); temperature: 47° C.

Flow rate of dry air: nitrogen gas for the secondary step: 1,500 L/min; partial pressure of ethyl acetate: 0; temperature: 60° C.

Example 3

The procedure of Example 1 was repeated, except that the drying conditions were changed as follows, to thereby produce toner c and a developer.

[Drying Conditions]

Flow rate of dry air: nitrogen gas for the primary step: 145 L/min (velocity: 30 m/sec); partial pressure of ethyl acetate: 1/10 (with respect to saturated vapor pressure of ethyl acetate); temperature: is 25° C.

Flow rate of dry air: nitrogen gas for the secondary step: 300 L/min; partial pressure of ethyl acetate: 0; temperature: 60° C.

Example 4

The procedure of Example 1 was repeated, except that the drying conditions were changed as follows, to thereby produce toner d and a developer.

[Drying Conditions]

Flow rate of dry air: nitrogen gas for the primary step: 120 L/min (velocity: 20 m/sec); partial pressure of ethyl acetate: ⅙ (with respect to saturated vapor pressure of ethyl acetate); temperature: 30° C.

Flow rate of dry air: nitrogen gas for the secondary step: 300 L/min; partial pressure of ethyl acetate: 0; temperature: 60° C.

Comparative Example 1

The procedure of Example 1 was repeated, except that the drying conditions were changed as follows, to thereby produce toner e and a developer.

[Drying Conditions]

Flow rate of dry air: nitrogen gas for the primary step: 0 L/min (velocity: 0 m/sec); partial pressure of ethyl acetate: -; temperature: -

Flow rate of dry air: nitrogen gas for the secondary step: 700 L/min; partial pressure of ethyl acetate: 0; temperature: 80° C.

Comparative Example 2

The procedure of Example 1 was repeated, except that the drying conditions were changed as follows, to thereby produce toner f and a developer.

[Drying Conditions]

Flow rate of dry air: nitrogen gas for the primary step: 200 L/min (velocity: 43 m/sec); partial pressure of ethyl acetate: 1/20 (with respect to saturated vapor pressure of ethyl acetate); temperature: 25° C.

Flow rate of dry air: nitrogen gas for the secondary step: 500 L/min; partial pressure of ethyl acetate: 0; temperature: 80° C.

Comparative Example 3

The procedure of Example 1 was repeated, except that the drying conditions were changed as follows, to thereby produce toner g and a developer.

[Drying Conditions]

Flow rate of dry air: nitrogen gas for the primary step: 410 L/min (velocity: 87 m/sec); partial pressure of ethyl acetate: ⅓ (with respect to saturated vapor pressure of ethyl acetate); temperature: 47° C.

Flow rate of dry air: nitrogen gas for the secondary step: 0 L/min; partial pressure of ethyl acetate: -; temperature: -

Table 1 given below collectively shows production conditions employed in Examples 1 to 4 and Comparative Examples 1 to 3.

TABLE 1

| | Drying conditions | | | | | | | |
|---|---|---|---|---|---|---|---|---|
| | Primarily drying step | | | | | Secondarily drying step | | |
| | Primary flow rate (L/min) | Velocity (m/sec) | Ethyl acetate partial pressure (vs. saturated vapor pressure) | Drying temp. (° C.) | Temp. of toner composition liquid (° C.) | Secondary flow rate (L/min) | Drying temp. (° C.) | Liquid droplet discharging velocity (m/sec) |
| Ex. 1 | 200 | 43 | 1/5 | 35 | 35 | 500 | 80 | 8 |
| Ex. 2 | 410 | 87 | 1/3 | 47 | 47 | 1,500 | 60 | 8 |
| Ex. 3 | 145 | 30 | 1/10 | 25 | 25 | 300 | 60 | 8 |
| Ex. 4 | 120 | 20 | 1/6 | 30 | 30 | 300 | 60 | 8 |
| Comp. Ex. 1 | 0 | 0 | — | — | 25 | 700 | 80 | 8 |
| Comp. Ex. 2 | 200 | 43 | 1/20 | 25 | 25 | 500 | 80 | 8 |
| Comp. Ex. 3 | 410 | 87 | 1/3 | 40 | 40 | 0 | — | 8 |

Each of the above-obtained toners was measured for mass average particle diameter ($D_4$), number average particle diameter (Dn), and a proportion of particles having a particle diameter of 12.7 μm or greater. The results are shown in Table 2.

Separately, each of the above-obtained developers was evaluated for cold offset property, hot offset property and filming property. The results are also shown in Table 2.

<Measurement of Particle Size Distribution>

The mass average particle diameter ($D_4$), the number average particle diameter (Dn), and the proportion of particles having a particle diameter of 12.7 μm or greater were obtained as follows: a toner sample was subjected to measurement using a particle size analyzer (Multisizer III, product of Beckman Coulter Co.) with the aperture diameter being set to 100 μm, and the obtained measurements were analyzed with analysis software (Beckman Coulter Multisizer 3 Version 3.51.). Specifically, a 10% by mass surfactant (alkylbenzene sulfonate, Neogen SC-A, product of Daiichi Kogyo Seiyaku Co.) (0.5 mL) was added to a 100 mL-glass beaker, and a toner sample (0.5 g) was added thereto, followed by stirring with a microspartel. Subsequently, ion-exchange water (80 mL) was added to the beaker.

The obtained dispersion was dispersed with an ultrasonic wave disperser (W-113MK-II, product of Honda Electronics Co.) for 10 min. The resultant dispersion was measured using the above Multisizer III and Isoton III (product of Beckman Coulter Co.) serving as a solution for measurement. The dispersion containing the toner sample was dropped so that the concentration indicated by the meter fell within a range of 8%±2%. Notably, in this method, it is important that the concentration is adjusted to 8%±2%, considering attaining measurement reproducibility with respect to the particle diameter. No measurement error is observed, so long as the concentration falls within the above range.

Based on the measured mass and number of the toner, the corresponding mass distribution and number distribution were calculated. The mass average particle diameter ($D_4$) and the number average particle diameter (Dn) of the toner were calculated from these volume distribution and number distribution. As a measure for particle size distribution, there is used the ratio $D_4$/Dn of the mass average particle diameter of the toner ($D_4$) to the number average particle diameter of the toner (Dn). When the toner has a monodisperse distribution, the ratio $D_4$/Dn is 1. The larger the ratio $D_4$/Dn of the toner, the broader the particle size distribution thereof.

Notably, in this measurement, 13 channels were used: 2.00 μm (inclusive) to 2.52 μm (exclusive); 2.52 μm (inclusive) to 3.17 μm (exclusive); 3.17 μm (inclusive) to 4.00 μm (exclusive); 4.00 μm (inclusive) to 5.04 μm (exclusive); 5.04 μm (inclusive) to 6.35 μm (exclusive); 6.35 μm (inclusive) to 8.00 μm (exclusive); 8.00 μm (inclusive) to 10.08 μm (exclusive); 10.08 μm (inclusive) to 12.70 μm (exclusive); 12.70 μm (inclusive) to 16.00 μm (exclusive); 16.00 μm (inclusive) to 20.20 μm (exclusive); 20.20 μm (inclusive) to 25.40 μm (exclusive); 25.40 μm (inclusive) to 32.00 μm (exclusive); and 32.00 μm (inclusive) to 40.30 μm (exclusive); i.e., particles having a particle diameter of 2.00 μm (inclusive) to 40.30 μm (exclusive) were subjected to the measurement.

<Cold Offset Property>

A fixing portion of the copier MF-200 (product of Ricoh Company, Ltd.) employing a TEFLON (registered trade mark) roller as a fixing roller was modified to produce a modified copier. A developer and plain paper sheets (Type 6000 paper, product of Ricoh Company, Ltd.) were set in the modified copier, and a printing test was performed while changing the temperature of the fixing roller in 5° C. steps. Subsequently, a pat was rubbed against the obtained fixed images. The cold offset property of a toner contained in the developer was evaluated based on the minimum fixing temperature; i.e., a temperature of the fixing roller at which the image density of the thus-rubbed image was 70% or higher. The minimum fixing temperature is preferably lower from the viewpoint of reducing power consumption. Toners having a minimum fixing temperature of 135° C. or lower are practically applicable. The minimum fixing temperature (i.e., cold offset-occurring temperature) of the toner was measured and evaluated according to the following evaluation criteria:

A: Minimum fixing temperature<135° C.; and

B: 135° C.≦minimum fixing temperature.

<Hot Offset Property>

The developer and plain paper sheets (Type 6000 paper, product of Ricoh Company, Ltd.) were set in a commercially available copier (imagio Neo 455, product of Ricoh Company, Ltd.). Images were formed/output while gradually increasing the fixing temperature. The offset-occurring temperature was defined as a temperature at which glossiness of the formed image degraded or at which an offset image was observed in the formed image. The offset-occurring temperature of the toner contained in the developer was measured and evaluated according to the evaluation following criteria:

A: 200° C.≦offset-occurring temperature; and

B: Offset-occurring temperature<200° C.

<Filming Property>

The developer and plain paper sheets (Type 6000 paper, product of Ricoh Company, Ltd.) were set in a commercially available copier (imagio Neo 455, product of Ricoh Company, Ltd.), and images with an image area ratio of 7% were printed out. After printing of 20,000 sheets, 50,000 sheets or 100,000 sheets, filming on the photoconductor and formation of an abnormal image (uneven density in a halftone image portion) caused by filming were evaluated according to the following evaluation criteria:

A: No filming occurred even after printing of 100,000 sheets;

B: Filming occurred at the time when 50,000 sheets were printed; and

C: Filming occurred at the time when 20,000 sheets were printed.

<Jettability>

The jettability of the toner composition liquid was observed at a voltage applied to the piezoelectric element of 10 V, 20 V or 30 V, and evaluated according to the following evaluation criteria:

A: Sufficient amount of the toner composition liquid was jetted at a voltage applied to the piezoelectric element of 10 V B: Sufficient amount of the toner composition liquid was jetted at a voltage applied to the piezoelectric element of 20 V C: Sufficient amount of the toner composition liquid was jetted at a voltage applied to the piezoelectric element of 30 V D: Small amount of the toner composition liquid was jetted at a voltage applied to the piezoelectric element of 30 V E: No toner composition liquid was jetted at a voltage applied to the piezoelectric element of 30 V Notably, at a voltage applied to the piezoelectric element of 30 V, the toner production apparatus was difficult to continuously operate due to heat generated by the piezoelectric element.

TABLE 2

| | Mass average particle diameter ($D_4$; μm) | ($D_4$/Dn) | Proportion of particles having a particle diameter of 12.7 μm or greater (%) | Cold offset property | Hot offset property | Filming property | Jettability |
|---|---|---|---|---|---|---|---|
| Ex. 1 | 5.3 | 1.02 | 0.4 | A | A | A | A |
| Ex. 2 | 5.5 | 1.04 | 0.8 | A | A | A | A |
| Ex. 3 | 5.1 | 1.02 | 0.4 | A | A | A | A |
| Ex. 4 | 5.6 | 1.12 | 0.9 | A | A | A | A |
| Comp. Ex. 1 | 9.4 | 2.42 | 16.8 | B | B | C | C |
| Comp. Ex. 2 | 5.8 | 1.06 | 1.2 | A | A | A | E (clogging occurred) |
| Comp. Ex. 3 | 6.2 | 1.74 | 3.8 | B | B | B | C |

As is clear from Table 2, the toner of Example 1 was found to be excellent in cold offset property, hot offset property and filming property.

In Examples 2 to 4, no nozzle clogging occurred. And, each of the obtained toners was found to have a very sharp particle size distribution, and to be excellent in cold offset property, hot offset property and filming property.

In contrast, in Comparative Example 1, some particles aggregated to generate coarse particles and thus, the toner was found to have a broad particle distribution.

In Comparative Example 2, during the course of toner production, nozzle clogging occurred at about 10 min intervals and nozzles necessitated washing. Note that the obtained toner was found to have a uniform particle size distribution.

The toner produced with the toner production method of the present invention has an excellent monodispersibility, low-temperature fixing property and offset resistance; and can consistently form a high-resolution, high-definition, high-quality image over a long period of time. Thus, it can be suitably used in a developer for developing a latent electrostatic image in, for example, electrophotography, electrostatic recording and electrostatic printing.

What is claimed is:

1. A method for producing a toner, comprising:

periodically forming and discharging liquid droplets of a toner composition liquid containing at least a resin, a releasing agent and a colorant from a plurality of nozzles formed in a thin film which is provided in a reservoir for the toner composition liquid, by vibrating the thin film using a mechanically vibrating unit, and forming toner particles by solidifying the liquid droplets of the toner composition liquid, wherein the forming toner particles comprises primarily drying the liquid droplets discharged from the nozzles of the thin film under a stream of dry gas containing an organic solvent whose partial pressure is equal to or higher than 1/10 of a saturated vapor pressure thereof but is equal to or lower than the saturated vapor pressure, the saturated vapor pressure being that at a drying temperature; and secondarily drying the primarily dried liquid droplets for solidification while the organic solvent is being evaporated.

2. The method according to claim 1, wherein the organic solvent is a mixture of one or more organic solvents each having a boiling point of 45° C. to 120° C. at normal pressure.

3. The method according to claim 2, wherein the organic solvent is at least one selected from ethyl acetate, acetone, ethyl alcohol, methyl ethyl ketone and toluene.

4. The method according to claim 1, wherein the dry gas is fed at a velocity 3 times to 20 times that at which the liquid droplets are discharged from the nozzles of the thin film, in a direction in which the liquid droplets are discharged.

5. The method according to claim 4, wherein the velocity at which the dry gas is fed is 5 times to 20 times that at which the liquid droplets are discharged.

6. The method according to claim 3, wherein the organic solvent is ethyl acetate and the drying temperature in the primarily drying is 25° C. to 65° C.

7. The method according to claim 6, wherein the secondarily drying is performed at a drying temperature of 55° C. to 110° C.

8. The method according to claim 1, wherein the toner composition liquid to be discharged has the same temperature as the drying temperature in the primarily drying.

9. The method according to claim 1, wherein the toner particles have a mass average particle diameter of 3 μm to 8 μm.

10. The method according to claim 1, wherein a ratio of a mass average particle diameter of the toner particles to a number average particle diameter of the toner particles is 1.25 or less.

11. The method according to claim 1, wherein a proportion of toner particles having a particle diameter of 12.7 μm or greater is 1% or less with respect to all the toner particles.

12. The method according to claim 1, wherein the resin has a glass transition temperature of 35° C. to 80° C.

13. The method according to claim 1, wherein the colorant is contained in the toner in an amount of 1% by mass to 15% by mass.

14. The method according to claim 1, wherein the releasing agent is an acid-modified hydrocarbon wax.

15. The method according to claim 1, wherein the releasing agent has an acid value of 1 KOHmg/g to 90 KOHmg/g.

16. The method according to claim 1, wherein the releasing agent has a melt viscosity at 120° C. of 1.0 mPa·s to 30 mPa·s.

17. The method according to claim 1, wherein the releasing agent has a melting point of 55° C. to 90° C.

18. The method according to claim 1, wherein an amount of the releasing agent is 0.1 parts by mass to 20 parts by mass per 100 parts by mass of the resin.

* * * * *